US007737912B2

(12) United States Patent
Graef et al.

(10) Patent No.: US 7,737,912 B2
(45) Date of Patent: Jun. 15, 2010

(54) PORTABLE ELECTRONIC DISPLAY DEVICE WITH AUTOMATIC LOCKOUT OF MESSAGE SELECTION SWITCHES TO PREVENT TAMPERING WITH SELECTED MESSAGE

(75) Inventors: John T. Graef, State College, PA (US); Eric Kline, State College, PA (US); Philip R. Hall, Ottsville, PA (US)

(73) Assignee: Intuitive Control Systems, LLC, State College, PA (US)

( * ) Notice: Subject to any disclaimer, the term of this patent is extended or adjusted under 35 U.S.C. 154(b) by 1499 days.

(21) Appl. No.: 11/054,710

(22) Filed: Feb. 9, 2005

(65) Prior Publication Data

US 2005/0210722 A1 Sep. 29, 2005

Related U.S. Application Data

(60) Provisional application No. 60/543,021, filed on Feb. 9, 2004.

(51) Int. Cl.
*G09G 5/00* (2006.01)

(52) U.S. Cl. ..... 345/1.1; 345/1.3; 345/901; 40/610

(58) Field of Classification Search ..... 345/1.1–1.3, 345/169, 905, 901; 40/610–612, 538, 539, 40/584, 606.01

See application file for complete search history.

(56) References Cited

U.S. PATENT DOCUMENTS 4,259,660 A 3/1981 Oliver
5,097,612 A 3/1992 Williams
5,502,909 A 4/1996 Rabkin (Continued)

FOREIGN PATENT DOCUMENTS

CN 2324597 Y 6/1999

(Continued)

OTHER PUBLICATIONS

ADSIed Wireless LED Message Technology for Outdoor and Indoor Applications, ADSIed, Inc., Austin, Texas, printout from ADSIed web site: http://www.adsled.com/?sendroicid=6d8ab868-8d9f-4424-8cfb-5356e46be968&sendroikwd=electronic+sign, printout date: Dec. 20, 2004, first posting date is unknown, 2 pages.

(Continued)

*Primary Examiner*—Kimnhung Nguyen
(74) *Attorney, Agent, or Firm*—Pantich Schwarze Belisario & Nadel LLP

(57) ABSTRACT

A portable electronic display device includes an electronic display surface having at least one display panel that displays a graphical and/or textual message, memory that stores a plurality of the messages, and one or more switches on the device that allow user selection of one of the messages. The device further includes a controller that disables the one or more switches if none of the switches are selected after a predetermined period of time after power is turned on to the display device, or if none of the switches are selected after a predetermined period of time subsequent to the last switch selection occurrence. In this manner, a person is prevented from subsequently changing the message via the one or more switches.

4 Claims, 28 Drawing Sheets

U.S. PATENT DOCUMENTS

| | | | | |
|---|---|---|---|---|
| 5,534,888 | A * | 7/1996 | Lebby et al. | 345/672 |
| 5,555,163 | A | 9/1996 | Pisani | |
| 5,734,513 | A | 3/1998 | Wang et al. | |
| 5,761,485 | A * | 6/1998 | Munyan | 715/839 |
| 5,767,822 | A | 6/1998 | Hiroshi | |
| 5,896,575 | A * | 4/1999 | Higginbotham et al. | 455/566 |
| 5,914,698 | A | 6/1999 | Nicholson et al. | |
| 6,036,249 | A | 3/2000 | Kuntz | |
| 6,037,866 | A | 3/2000 | Leibowitz | |
| 6,175,342 | B1 | 1/2001 | Nicholson et al. | |
| 6,229,502 | B1 * | 5/2001 | Schwab | 345/1.1 |
| 6,314,669 | B1 | 11/2001 | Tucker | |
| 6,323,832 | B1 | 11/2001 | Nishizawa et al. | |
| 6,414,650 | B1 | 7/2002 | Nicholson et al. | |
| 6,455,767 | B1 | 9/2002 | Muller | |
| 6,634,124 | B1 | 10/2003 | Bierschbach | |
| 2002/0005826 | A1 | 1/2002 | Pederson | |
| 2002/0162256 | A1 | 11/2002 | Wardle et al. | |
| 2003/0071832 | A1 | 4/2003 | Branson | |
| 2003/0158753 | A1 * | 8/2003 | Bernston et al. | 705/2 |
| 2003/0160754 | A1 | 8/2003 | Hanson et al. | |
| 2003/0161094 | A1 | 8/2003 | Chambers | |
| 2004/0004604 | A1 * | 1/2004 | Numano | 345/173 |
| 2004/0203571 | A1 * | 10/2004 | Hashizume | 455/404.1 |
| 2005/0278998 | A1 | 12/2005 | Sawhney et al. | |
| 2006/0017658 | A1 | 1/2006 | Biondo et al. | |

FOREIGN PATENT DOCUMENTS

| | | |
|---|---|---|
| JP | 2001-51629 | 2/2001 |
| WO | WO 02/33685 A1 | 4/2002 |
| WO | WO 02/061558 A2 | 8/2002 |

OTHER PUBLICATIONS

Electronic Displays Inc., Addison, Illinois, Product descriptions in printout from EDI web site: http://www.electronicdisplays.com/prodcat/default.asp?cstop=2&pcid=6, printout date: Dec. 20, 2004, first posting date is unknown, 8 pages.

Product brochure for SPEEDsentry™ Radar Speed Display & Trailer, All Traffic Solutions, State College, Pennsylvania, product introduced in Mar. 2003, 4 pages.

"International Preliminary Report on Patentability" for PCT/US05/04355, date of mailing: Mar. 15, 2007, 5 pages.

"Notification of Transmittal of the International Search Report and the Written Opinion of the International Searching Authority . . . " for PCT/US05/04355, date of mailing: Oct. 23, 2006, 8 pages.

* cited by examiner

PORTABLE ELECTRONIC DISPLAY DEVICE WITH AUTOMATIC LOCKOUT OF MESSAGE SELECTION SWITCHES TO PREVENT TAMPERING WITH SELECTED MESSAGE

CROSS REFERENCE TO RELATED APPLICATIONS

This application claims priority to U.S. Provisional Patent Application No. 60/543,021 filed Feb. 9, 2004.

BACKGROUND OF THE INVENTION

1. Field of the Invention

The present invention relates to electronic message signs and displays, and more particularly, to a portable foldable electronic display with illuminable elements. One possible use is to provide informational or emergency messages to the public.

2. Background

Police officers and emergency personnel use a variety of means (e.g. signs and displays, flares, flashing lights, flashlights) for warning approaching traffic of an accident or emergency situation. The illuminable electronic variable message sign is one of the most effective devices for warning approaching traffic and communicating appropriate instructions to the traffic. To enhance safety, it is important for police or emergency personnel to be able to dispatch and deploy a variable message sign at the accident or emergency scene as quickly as possible, as the likelihood of citizen and emergency personnel injury and/or death increases with delays in variable message sign dispatch and deployment. For optimal effectiveness, the signs are mounted so that text or graphic messages can be seen at a distance, generally elevated or optimally positioned.

Many types of message signs are known in the art. For instance, non-illuminable caution signs that are folded to facilitate portability are disclosed in U.S. Pat. No. 5,097,612 (Williams); U.S. Pat. No. 6,036,249 (Kuntz); U.S. Pat. No. 6,037,866 (Leibowitz); U.S. Pat. No. 5,502,909 (Rabkin); and U.S. Published Patent Application No. 2002/0005826 (Pederson). Some electronic variable message signs are permanently installed on roadways or on permanently positioned trailers and are only useful for situations in close proximity to each sign's location or for general informational purposes. Other large message signs, which are mounted in the back of highway maintenance vehicles or are mounted to tow-behind trailers for that purpose are disclosed in U.S. Pat. No. 5,914,698 (Nicholson et al.); U.S. Pat. No. 6,414,650 (Nicholson et al.); U.S. Pat. No. 6,150,996 (Nicholson et al.); and U.S. Pat. No. 6,175,342 (Nicholson et al.). These signs are portable and, as such, are suited for conveying messages to motorists on a relatively temporary basis, when time allows for their deployment and local conditions allow for their setup and positioning.

The above-mentioned art has a number of shortcomings that detract from user and citizen safety. Most notably, the message signs mounted on trailers are cumbersome and difficult to set up, often requiring more than one person and long setup times incompatible with emergency situations. The signs require a large vehicle, generally a truck, for towing. If the truck cannot get to the scene of an accident, possibly due to congestion or unavailability of the tow vehicle, or the trailer cannot be utilized due to space limitations or limited positioning options at the scene of an incident, the sign is not helpful to the incident. In situations where the message signs can be deployed, their lengthy setup times prevent the signs from being deployed in a timely fashion. For the entire time the sign is being set up the first responders to the accident scene are exposed to increased danger due to uninformed approaching traffic. Many incidents are of a short duration and by the time a message sign can be deployed, the incident has been resolved. Moreover, the signs are not immediately accessible in the event of an emergency, as their large size dictates that they be stored in a remote storage facility. As a result of these shortcomings, law enforcement, first responders, and other emergency management personnel who rely on message signs for safety experience difficulty in communicating with the public on short notice.

A related significant shortcoming of the message signs is that they do not allow an operator to quickly display a stored message and/or a newly created message loaded at an incident with information specific to the current situation. The message signs fail to provide a means for programming, modifying or changing a message quickly and simply, to address specific or customized roadway or emergency messages. These deficiencies are due, in part, to the fact that the signs are complicated to program, and frequently include a tethered controller that must be kept in a locked compartment on the trailer or be integral to the sign itself in order to prevent unauthorized access to the control over a displayed message.

A further shortcoming of the current message signs is that they cannot be used independently of a trailer. By design, the signs are a component of a trailer message system. As a result, a message sign cannot be mounted directly to a vehicle or to a portable or stationary pole. In this restrictive mounting scheme, the trailer's position and orientation are both integral parts of the sign's operation, limiting the ability to rapidly deploy the message sign in an optimal position during urgent situations.

A still further shortcoming of message signs known in the art is that they fail to provide a secure means for preventing messages from being changed inadvertently or by unauthorized users without having the controls secured in a locked compartment. To be tamper resistant, it is important for a sign to have mechanical and/or electronic locking mechanisms to ensure that the intended message is not changed by unauthorized personnel.

Therefore, there is a need for a fully portable, foldable electronic display for reliably communicating messages to the public for the control of road and highway traffic, while protecting officer and citizen safety.

BRIEF SUMMARY OF THE INVENTION

The present invention is a foldable electronic display device especially useful for highway traffic control and incident management, as well as other display purposes. Generally known for this use as a variable or changeable message sign, the variable message sign can display informational or emergency messages for the control of roadway and highway traffic. The electronic display consists of a plurality of electronic display panels or surfaces that together display a desired textual, visual or graphical message. The foldable electronic display is designed to be lightweight and portable and can be handled and setup easily and quickly by one person. When not in use, the display may be stowed in the luggage compartment of police cars or highway maintenance and emergency response vehicles in a folded orientation for convenient storage and easy retrieval on short notice.

One preferred embodiment of the present invention additionally offers an on-board control software lockout that prevents messages from being changed inadvertently or by unauthorized personnel so as to eliminate the need for mechanical security means limiting access to the electronic display's on-board controls.

An optional mounting bracket assures that the foldable electronic display is held in an open orientation, i.e., with all electronic display panels generally facing the intended viewer. The mounting bracket can be installed in a manner that, with the foldable electronic display installed and locked in place, the display and mounting bracket are tamperproof. This mounting system prevents unauthorized access to the mounting hardware with the electronic display locked in place.

Accordingly, the present invention provides a portable and secure foldable electronic display for providing important or emergency messages to the public. Furthermore, one individual can easily and quickly erect the foldable electronic display.

The present invention provides a portable foldable electronic display for displaying variable messages in a quickly deployable package.

The present invention provides a foldable electronic display having multiple message electronic display panels on each side of one or multiple folds with a flexible mounting system that affords a user complete flexibility in display positioning.

The present invention provides a foldable electronic display that can be programmed to display a customized message with internally stored messages using accessible on-board controls, such as switches, yet with an integral software lockout feature to prevent unauthorized changes to the display using the on-board controls.

The present invention provides a foldable electronic display that protects electronic interconnect cabling between display panels from crimping and damage.

Other objects of the present invention will be readily apparent from the following description of the invention and the related drawings.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. However, the invention is not limited to the precise arrangements and instrumentalities shown.

In the drawings.

DETAILED DESCRIPTION OF THE INVENTION

Certain terminology is used herein for convenience only and is not to be taken as a limitation on the present invention.

The subject of the present invention is a portable, variably illuminable foldable electronic display, generally known in one use as a variable or changeable message sign, that provides, for example, informational or emergency messages for the control of roadway and highway traffic. The display is designed to be lightweight and portable and can be transported and setup easily and quickly by one person. When not in use, the display may be conveniently stowed in the luggage compartment of police cars or highway maintenance and emergency response vehicles in a folded orientation. The elements of the sign must allow for the display to fold, requiring a rigid structure with hinge mechanisms, the ability to communicate electronic signals across the fold line and provisions to hold the display open when in use and closed when stored. Additionally, the display will have elements allowing easy transport and mounting.

Figure 1:
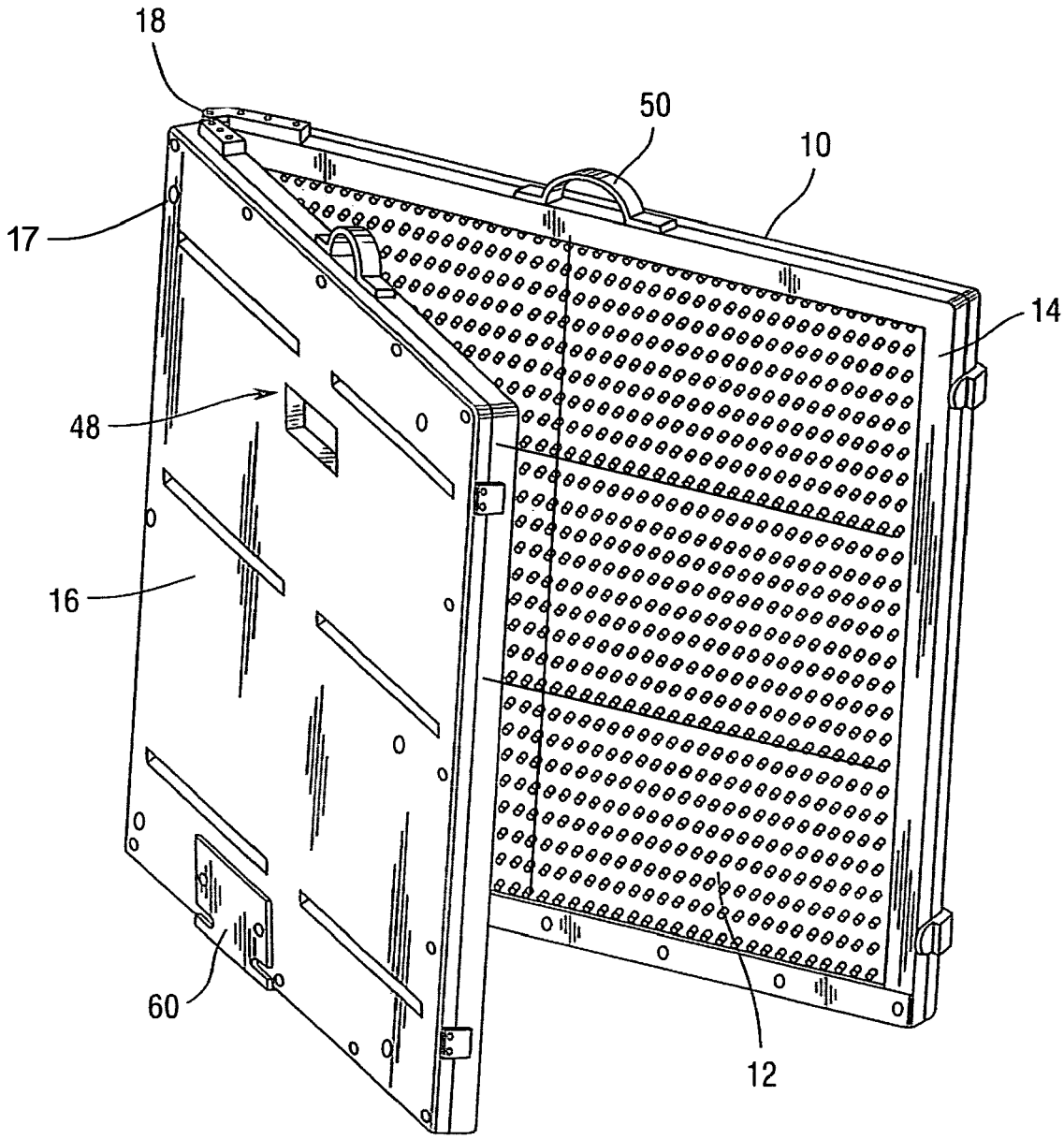
FIG. 1 is an isometric view of an unmounted foldable electronic display in a partially folded orientation.
Figure 2:
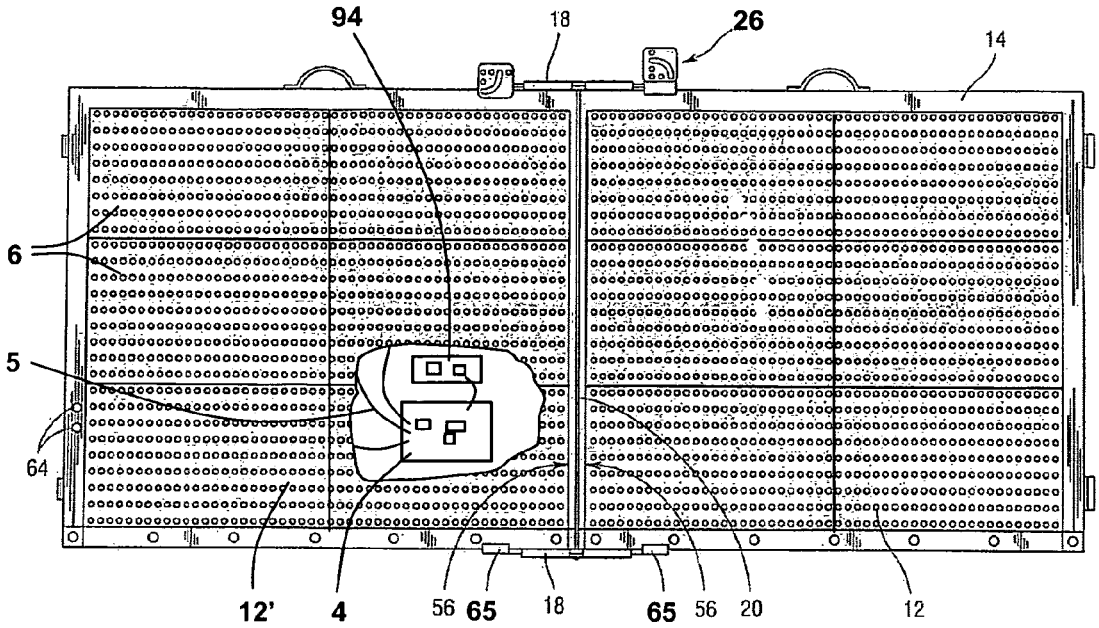
FIG. 2 is a front elevation view of a foldable electronic display in its operational and open orientation. The mounting bracket can be partially seen at the top and bottom of the display, holding the display in the generally open orientation. This view also shows internal components.

FIG. 1 and FIG. 2 shows one preferred embodiment of a foldable electronic display 10 comprised of at least two display panels. FIG. 1 shows the display panels in a partially folded orientation and FIG. 2 shows the display panels in a fully open orientation. The foldable electronic display 10 is comprised of a first portion of illuminable pixels 12 and at least a second portion of illuminable pixels 12' housed within two or more outer enclosure frames 14 and back enclosure covers 16 that together comprise the electronic message surface. The first and second portions of illuminable pixels 12 and 12' may also be referred to as the first and second display panels 12 and 12'. In one preferred embodiment, the outer enclosure frames 14 and back enclosure covers 16 are constructed from aluminum, but may be constructed from a variety of other commercially available materials, such as plastic or other metals. The outer enclosure frames 14 and back enclosure covers 16 are of a construction and thickness that minimizes weight and facilitates strength and portability.

The outer enclosure frames 14 provide for the mounting of a transparent faceplate to protect the electronic message surface. Referring to both FIG. 1 and FIG. 2, the foldable electronic display 10 display panels 12 and 12' are adjoined by at least two hinge mechanisms 18 (also, referred to as "projections") that allow the display panels 12 and 12' of the foldable electronic display 10 to fold, thereby facilitating easier storage. In one preferred embodiment shown in FIG. 1, the hinge mechanisms 18 are positioned such that the display 10 folds with the electronic message surface of the first display panel 12 facing or flush with the electronic message surface of the second display panel 12' which allows for protection of the electronic message surfaces in the folded and stored position.

In one preferred embodiment shown in the figures, the hinge mechanisms 18 of the present invention connect the outer enclosure frame 14 and back enclosure cover 16 of one display panel to the outer enclosure frame 14 and back enclosure cover 16 of another display panel so that the display panels 12 and 12' may be folded together to facilitate more compact storage and easier portability. The hinge mechanism 18 may be located such that the fold takes place along front corners of the outer enclosure frames 14, minimizing the gap in the illuminable pixels. The edges 56 of the outer enclosure frames 14 are minimized to reduce the distance between the pixels and yet still allow for sealing of the foldable electronic display panels from the elements. FIG. 1 shows the present invention in one preferred embodiment with hinges at the horizontal center of the display so that the display may be folded into two display panels such that generally none of the electronic message surface comprised of a first display panel 12 and a second display panel 12' is exposed when the display 10 is folded closed. In one preferred embodiment, the hinge mechanisms 18 are of a type that minimizes the display's gap at the fold line 20 so text and graphical messages displayed on the electronic message surface appear continuous.

As discussed above, in one preferred embodiment, two display panels may fold such that the illuminable faces of the first display panel 12 and the second display panel 12' are facing one another. This provides greater protection of each display panel of the electronic message surface during transport and storage than the protection provided by the transparent faceplate alone. Alternatively, two display panels may fold such that the back enclosure cover 16 of each display panel are touching, are facing one another, or such that the electronic message surface of one display panel is against the back of the other display panel of the display. For certain applications, it may be desirable to only use one display panel of the electronic message surface. In such applications, the unused panel serves as a protective cover and may or may not have illuminable elements. It is also possible to have illuminable electronic message surfaces on the front display panels 12 and 12' and back surfaces on the back enclosure cover 16 of the foldable electronic display.

The structure or frame of one preferred embodiment of the present invention shown in the drawings has both outer enclosure frames 14 and back enclosure covers 16. The frame members 14, 16 are preferably formed of aluminum. However, other types of enclosure configurations and materials could be used, such as vacuum formed plastic enclosures or extruded aluminum. The important criteria is for the frame members 14, 16 to be rigid, lightweight, support a display surface, and allow for mounting of hinges to facilitate folding of the display 10. There are other possible configurations and combinations of frame members 14 and 16 known to those skilled in the art that will provide the same function and utility for the foldable electronic display.

Figure 13A:
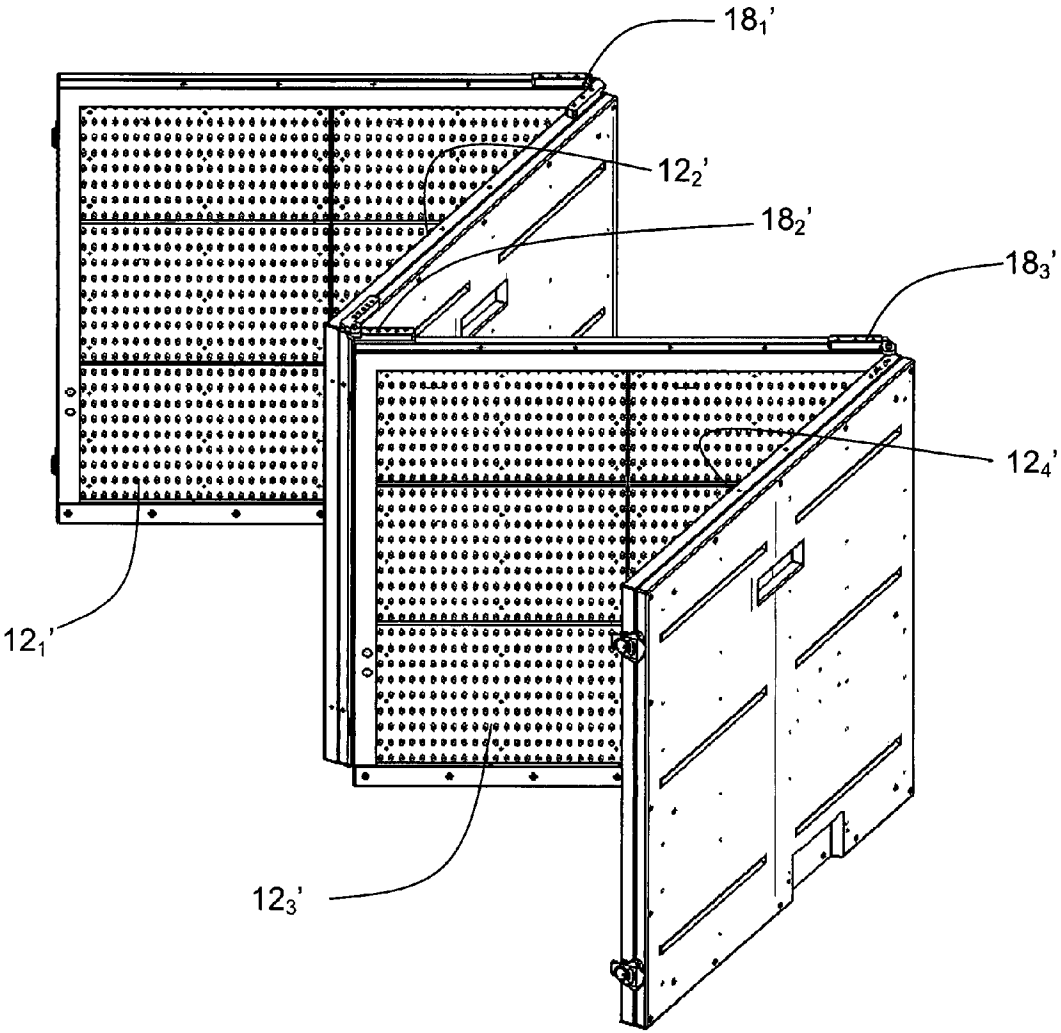
FIGS. 13A and 13B are views of alternate embodiments of foldable electronic displays formed of a multiplicity of electronic display panels.
Figure 13B:
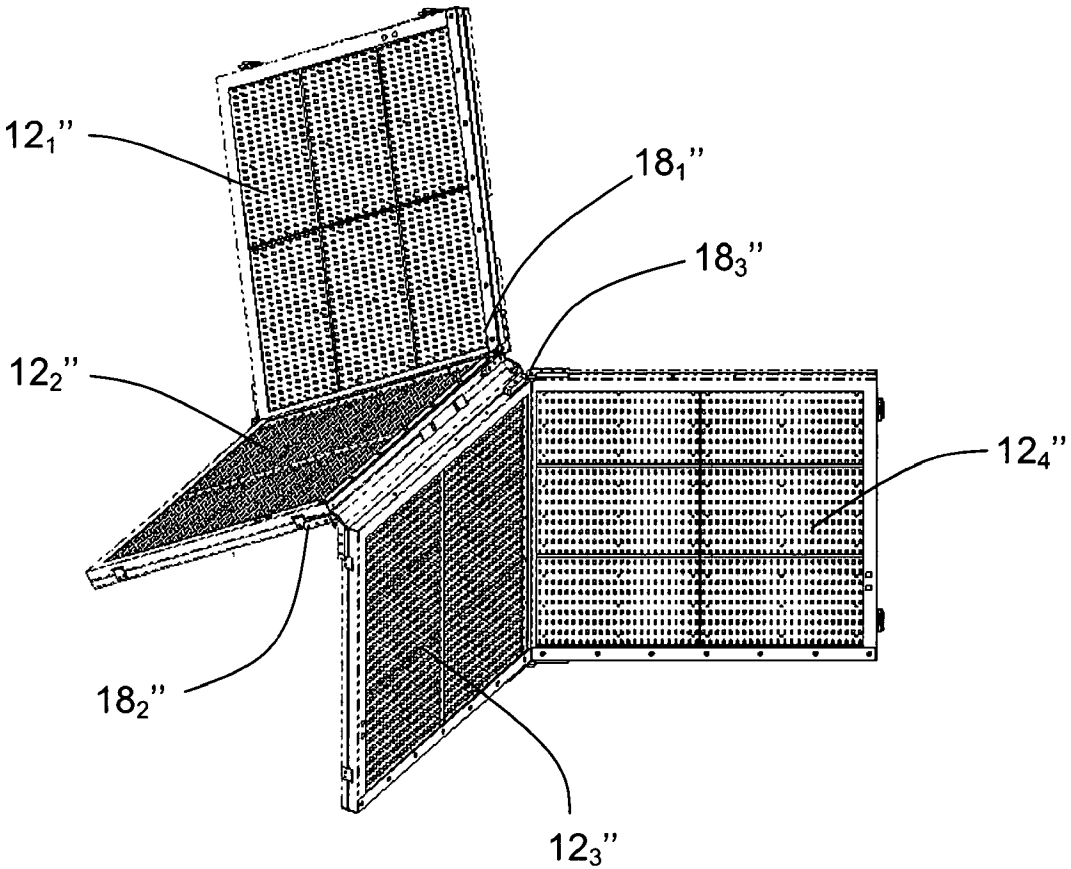

Many hinge mechanisms 18 exist that would be consistent with the intent of the present invention. Any mechanism used to adjoin a plurality of display panels of the foldable electronic display 10 that will allow the unit to be used in an open orientation and will allow foldable electronic display 10 to be stored in a folded orientation can be used. Further, preferred hinges will allow the display panels to be maintained relative to each other so that the gap at the fold line 20 between the display panels is at a minimum. Hinges 18 of the type that attach to the edge of the display 10 as shown in the figures as well as hinges that attach along the fold line 20 can be used. The preferred hinges have a center of rotation that is precisely located at the closest corners of the display surface edge of each display panel of the display 10, allowing for a minimum gap between the sections, and thus, a minimum gap in the text of the display 10. The hinge mechanism 18 which is used to facilitate folding along a vertical line in one preferred embodiment may also be utilized in a horizontally pivoting configuration, or in combination with a horizontally pivoting configuration (e.g. a four-way fold) or with multiple vertical or horizontal pivoting configurations. Examples of these alternative configurations are shown in FIGS. 13A and 13B.

One preferred embodiment of the present invention comprises two display panels that fold with the fold line 20 vertically oriented, as shown in FIG. 2. Alternatively, multiple folds may be allowed, and the lines of the fold may be oriented both vertically and horizontally. In one preferred embodiment, the fold line 20 is a vertical line proximate to the center of the display positioned between display panels of the foldable electronic display 10 that are of the similar size and weight. Configurations with a multiplicity of display panels 12 that together comprise an electronic display surface that can be folded for transport and unfolded for display of textual or graphical messages are shown in FIG. 13A having reference display panels $\mathbf{12_1'}$-$\mathbf{12_4'}$ and hinge mechanisms $\mathbf{18_1'}$-$\mathbf{18_3'}$ and FIG. 13B having reference display panels $\mathbf{12_1''}$-$\mathbf{12_4''}$ and hinge mechanisms $\mathbf{18_1''}$-$\mathbf{18_3''}$.

While the size and weight of the frame may vary considerably, the frame members 14, 16 are generally designed to provide optimum visibility on the road, and ease of handling by a user in the display's 10 folded state as well as in its open orientation. In this regard, the display 10 is truly portable and can be erected and folded with ease, by a single individual, in a minimal amount of time. The diverse features of the present invention may be included on message signs and other electronic displays of smaller or significantly larger proportions.

Figure 5:
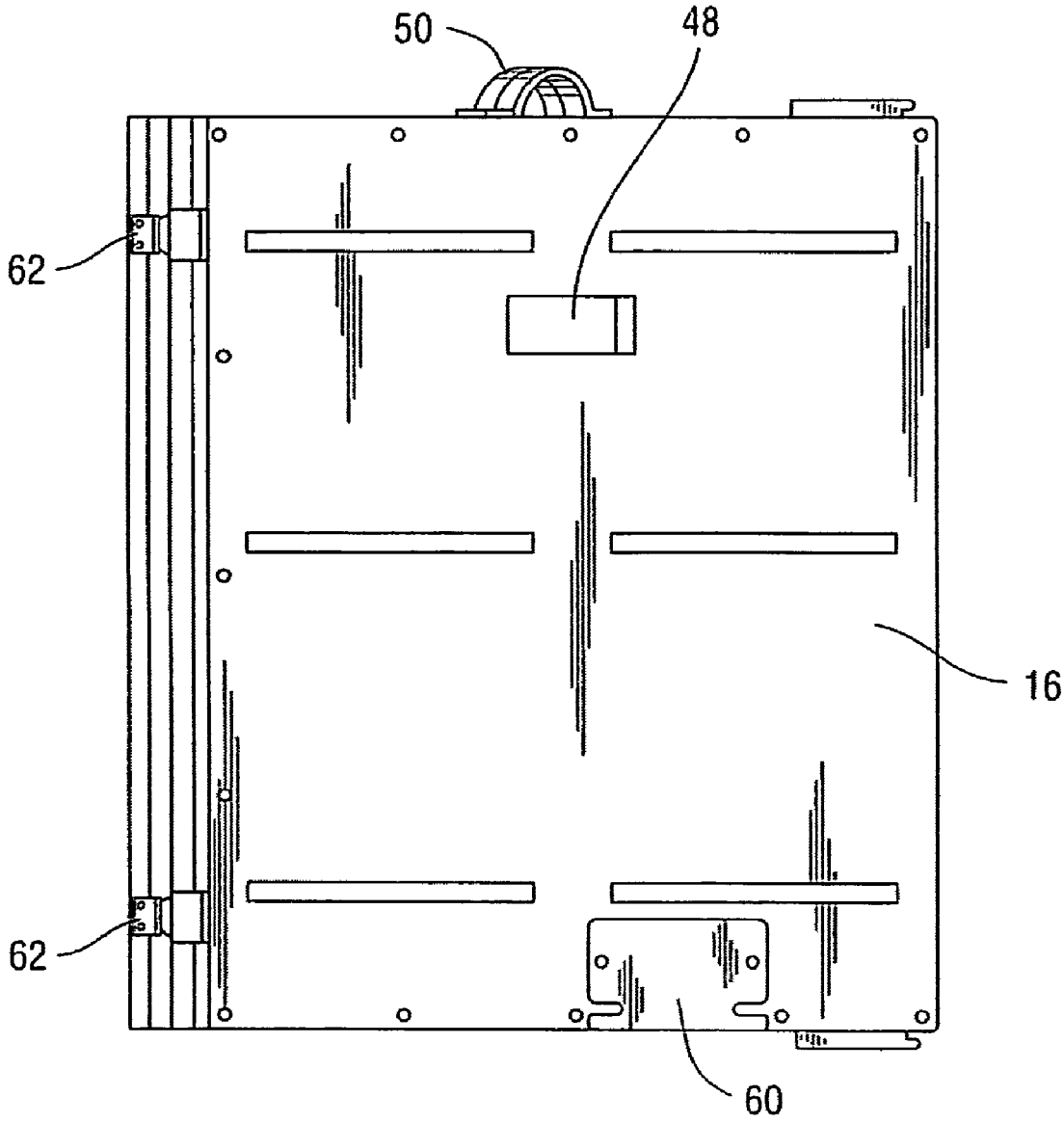
FIG. 5 is an isometric view of an unmounted foldable electronic display in a fully folded orientation.

In one preferred embodiment, the present invention includes a pair of carrying handles 48 shown in FIG. 1 integral to the back enclosure cover 16. The carrying handles 48 allow a user to hold and transport the foldable electronic display 10 without difficulty. The handles 48 are generally flush with the back enclosure cover 16 so that there is no protrusion from the frame. As shown in FIG. 1, strap handles 50 are attached to the top edge of the foldable electronic display 10 to permit convenient lifting of the display into a mounting bracket, yet the flexible straps fold flat for storage. Latches 62, shown in FIG. 5, are provided on the display frame to lock the foldable electronic display 10 in the fully folded orientation.

In a typical manufacturing process, a window is attached to each display panel of the outer enclosure frame 14, and hinge mechanisms 18 are attached to connect the respective display panels of the outer enclosure frame 14. Local controller boards 4, communication and option boards 94, connectors, display boards 6, and wiring harnesses 5 are assembled into the back enclosure covers 16. The back enclosure covers 16 are then attached to the outer enclosure frames 14 and latches 62 are installed, forming a completed foldable electronic display 10. Alternative modes of design and manufacture can be suitably employed with similar outcome and benefits.

Figure 3:
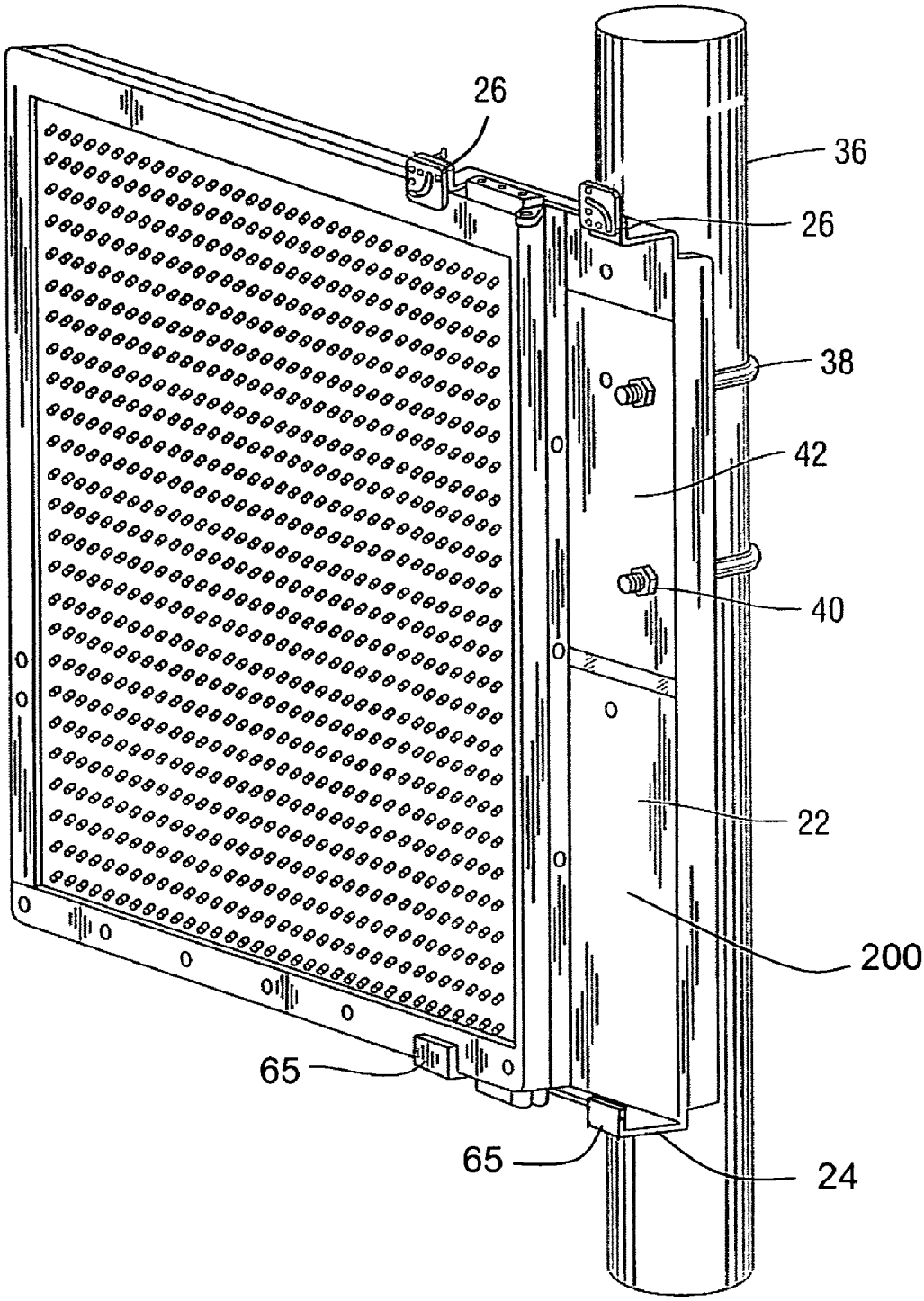
FIG. 3 is an isometric view showing a one display panel of a foldable electronic display mounted to a pole, with a second display panel hidden from view.
Figure 10A:
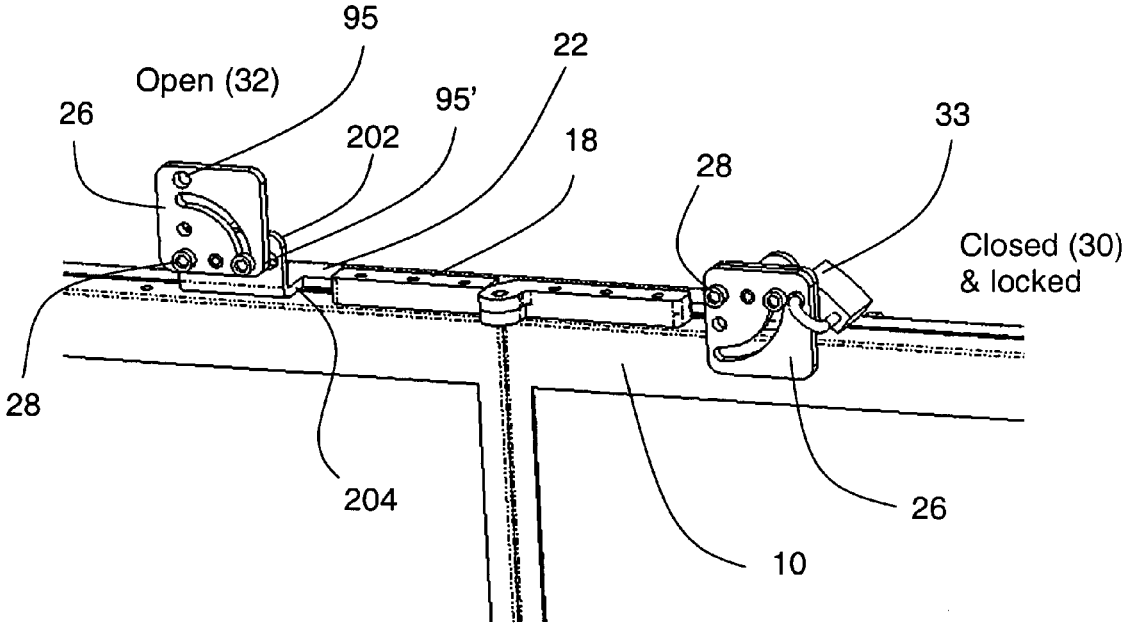
FIGS. 10A and 10B are views of the mounting plate retaining plate and lock feature.
Figure 10B:
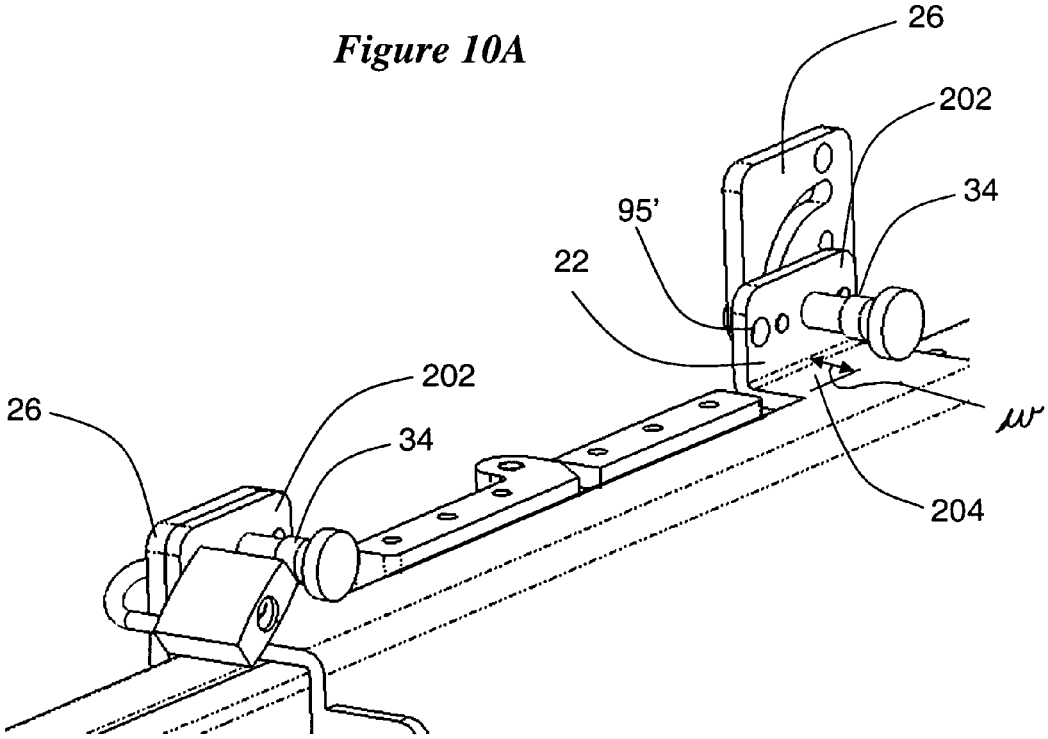

Referring to FIG. 3, the present invention may include a mounting bracket 22 to which the foldable electronic display 10 may be secured. In one preferred embodiment, the mounting bracket 22 is defined by a vertical member 200 and includes one or more retaining supports 24 used to support the bottom of the foldable electronic display 10. The retaining supports 24 may have one or more vertical retaining lips 65 that prevent the display from separating from the mounting bracket. In one preferred embodiment, the mounting bracket 22 includes two retaining supports 24. Other methods of securely attaching the bottom of the display to the mounting bracket are possible. In one preferred embodiment shown in FIGS. 3, 10A and 10B, the top of the display is retained by the mounting bracket 22 via a plurality of rotating retaining pieces 26 used to secure the top of the foldable electronic display 10. The rotating retaining plate 26 may rotate (i.e., swivel) through an angle of about 90 degrees about a pivot point 28. The rotating retaining plate 26 is attached via the pivot point 28 to a vertical lip 202 of the mounting bracket 22. A horizontal lip 204 is attached at one end to an upper edge of the vertical member 200 and at the other end to the vertical lip 202, thereby forming an L-shaped projection from the vertical member 200. The horizontal lip 204 allows the vertical lip 202 to extend outward and parallel to the vertical member 200. The width, w, of the horizontal lip 204 is slightly greater than the width of the edge of the display 10 so that the rotating retaining plate 26 can overlie the display 10 when pivoted into the closed position.

The foldable electronic display 10, having previously been desirably positioned within the confines of the mounting bracket, is secured when one or more rotating retaining plates 26 are in the "closed" position 30. (See the rightmost rotating retaining plate 26 in FIG. 10A.) The foldable electronic display 10 may be released from the mounting bracket when the rotating retaining plates 26 are in the "open" position 32. (See leftmost rotating retaining plate 26 in FIG. 10A.) A spring loaded pin 34 is provided for holding the rotating retaining plate 26 in its "open" position or "closed" position.

In one preferred embodiment, the mounting bracket 22 comprises two rotating retaining plates 26. The rotating retaining plates 26 and retaining supports 24 with vertical retaining lips 65 are located such that when the foldable electronic display 10 is attached to the mounting bracket 22, at least one rotating retaining plate 26 and one retaining support 24 are located on each display panel of the foldable electronic display's 10 fold line 20.

In operation, the mounting bracket's retaining supports 24 act as a shelf to hold the foldable electronic display 10 against gravity and the mounting bracket's rotating retaining plate 26 and the vertical retaining lips 65 hold the foldable electronic display 10 against the surface of the mounting bracket 22. Additionally, the at least one rotating retaining plate 26 or vertical retaining lips 65 on each side of the foldable electronic display's 10 fold line 20 assure the unit is held in a desirably open orientation with the electronic display panels 12 and 12' generally oriented towards the viewer. The hinge mechanisms 18, which are positioned between the rotating retaining plates 26 and/or the retaining supports 24 on the mounting bracket, and in one preferred embodiment extend beyond the enclosure of the electronic display 10, prevent the display 10 from sliding out from the side of the mounting bracket 22.

A user who is mounting the foldable electronic display 10 to the mounting bracket 22 will position one edge of the foldable electronic display 10 on the retaining support 24 inside of the vertical retaining features 65 with the hinge mechanism between the supports 24 and then push the opposite edge of the foldable electronic display 10 under the rotating retaining plates 26 while they are in the "open" position 32. The rotating retaining plates 26 are then rotated into the "closed" position 30 to secure the foldable electronic display 10. The user may optionally lock the rotating retaining plate 26 in the "down" position 30 with a conventional padlock 33 through a hole 95 and 95' through both the mounting bracket 22 and the rotating retaining plate 26 shown in FIG. 10B. The padlock 33 will prevent rotation of the rotating retaining plate 26, and therefore prevent removal of the display 10 from the mounting bracket 22.

The top of the display 10 can be secured via other means besides rotating retaining plates 26. The retaining plates 26 may slide or the retaining plates can be fixed on a slightly flexible tab on the mounting bracket 22 thus providing a "snap-fit" means of securing the display 10 to the mounting bracket. The goal is to secure the foldable display 10 in a manner that allows easy mounting and removal, and holds the display in an open orientation when mounted. Regardless of the mechanism used for the retaining plates 26, they can be viewed generically as having an engaged or closed position, and a disengaged or open position. Additionally, locking mechanisms may be provided to lock the display 10 to the mounting bracket 22 to help prevent unauthorized removal or theft of the display.

Figure 9B:
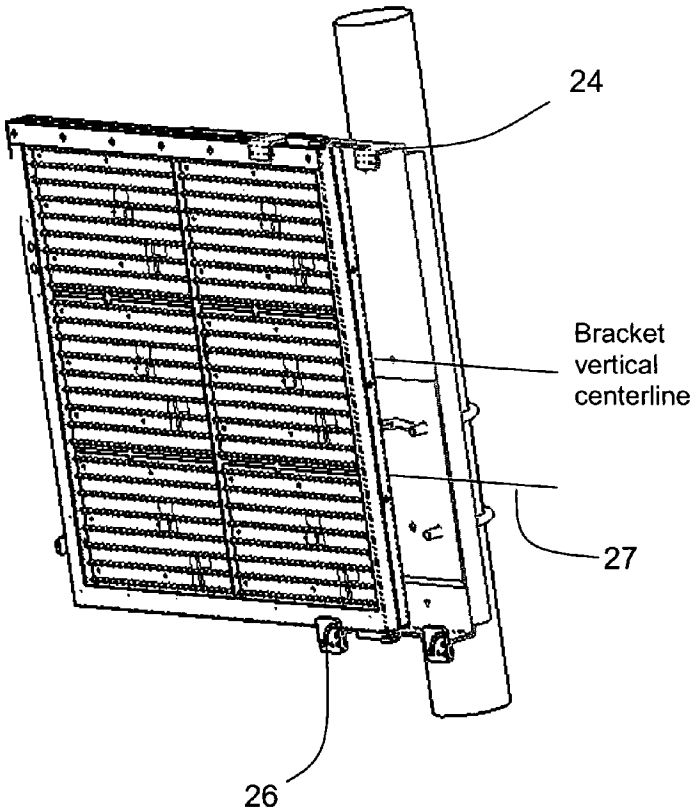
FIG. 9 is a view of the mounting bracket in low display orientation and high display orientation.
Figure 9A:
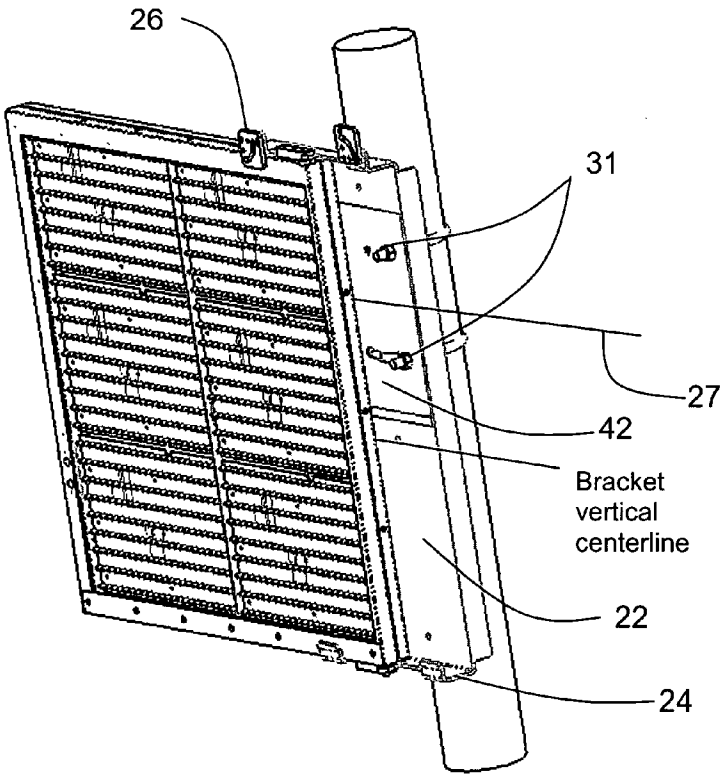

The mounting bracket may also be mounted such that the rotating retaining plate 26 is on the bottom and the retaining support 24 is on the top. Standard mounting holes 31 on the mounting bracket 22 are located off the horizontal center of the overall mounting bracket as shown in FIGS. 9A and 9B. In one case the mounting bracket is mounted with the retaining supports 24 on the bottom, FIG. 9A. The foldable electronic display 10 can be mounted at an elevated height with ease, by simply rotating the mounting bracket so the bottom of the bracket is now at the top with the retaining supports 24 at the top, FIG. 9B. It is attached to the mounting surface using the same hardware in the same position in the support as is was for the previous mounting position. This is achieved through use of the offset mounting holes relative to the horizontal centerline of the mounting bracket. The centerline of the mounting holes 27 is further from the bottom supports 24 than from the rotating retaining plate 26, which allows the elevated height by rotating the mounting bracket 180 degrees.

Figure 11:
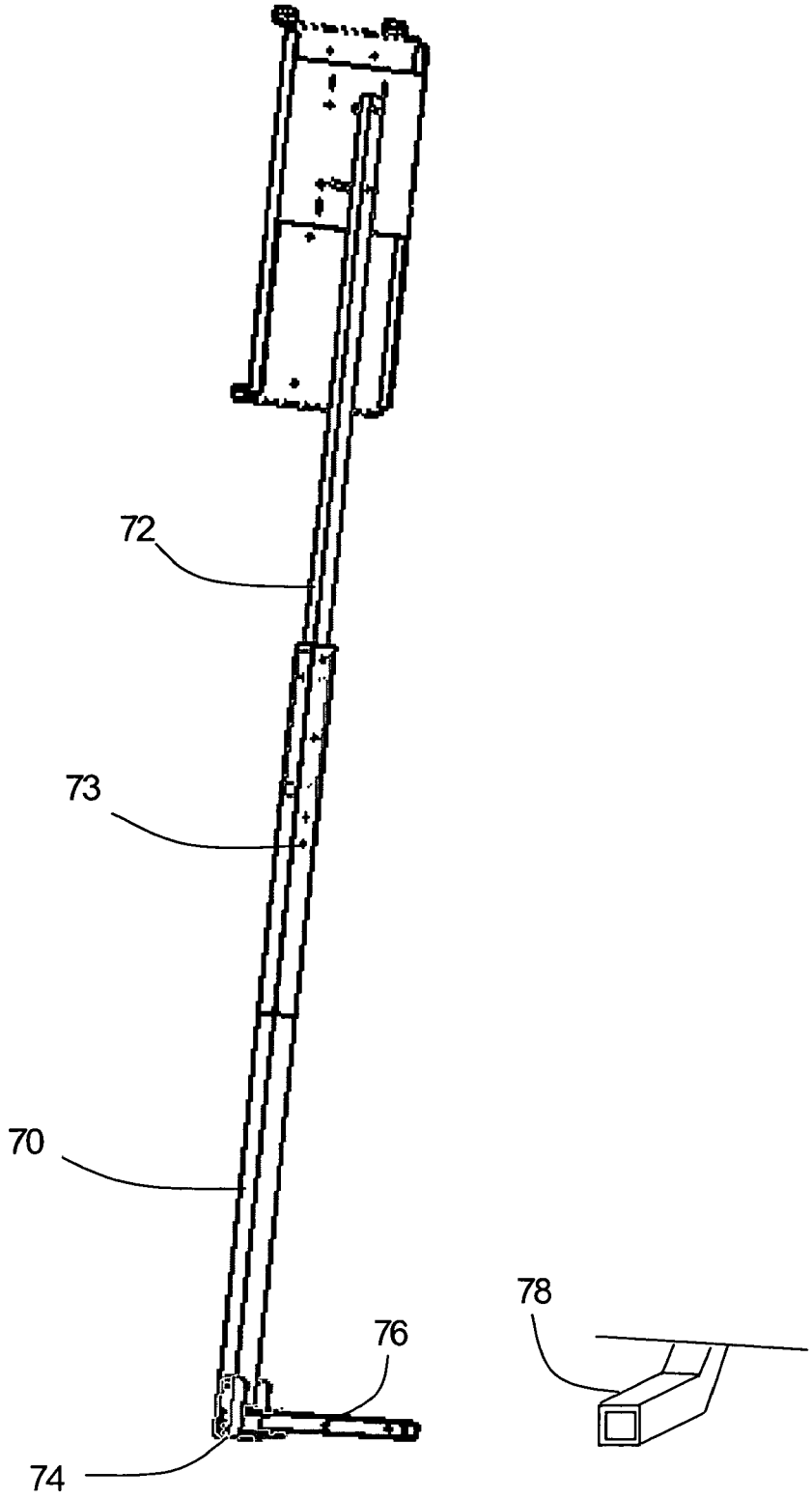
FIG. 11 is a view of the mounting plate attached to a telescoping, swiveling hitch bracket.

The mounting bracket 22 of FIG. 3 provides for mechanical mounting connections to structures such as posts and poles. In one preferred embodiment shown in FIG. 11, the mounting bracket 22 may be attached to a post that has a generally perpendicular extension 76 for insertion into a standard vehicle hitch receiver 78. This enables a user to conveniently mount the display 10 on a vehicle utilizing the vehicle's hitch receiver. This post may incorporate a telescoping insert 72 and a spring loaded pin 73 for varying the height at which the display 10 is secured. This post may also incorporate a swivel element 74 that allows the display 10 to be angled and therefore to be aligned with the intended viewer no matter the position of the vehicle to which it is attached.

Figure 8:
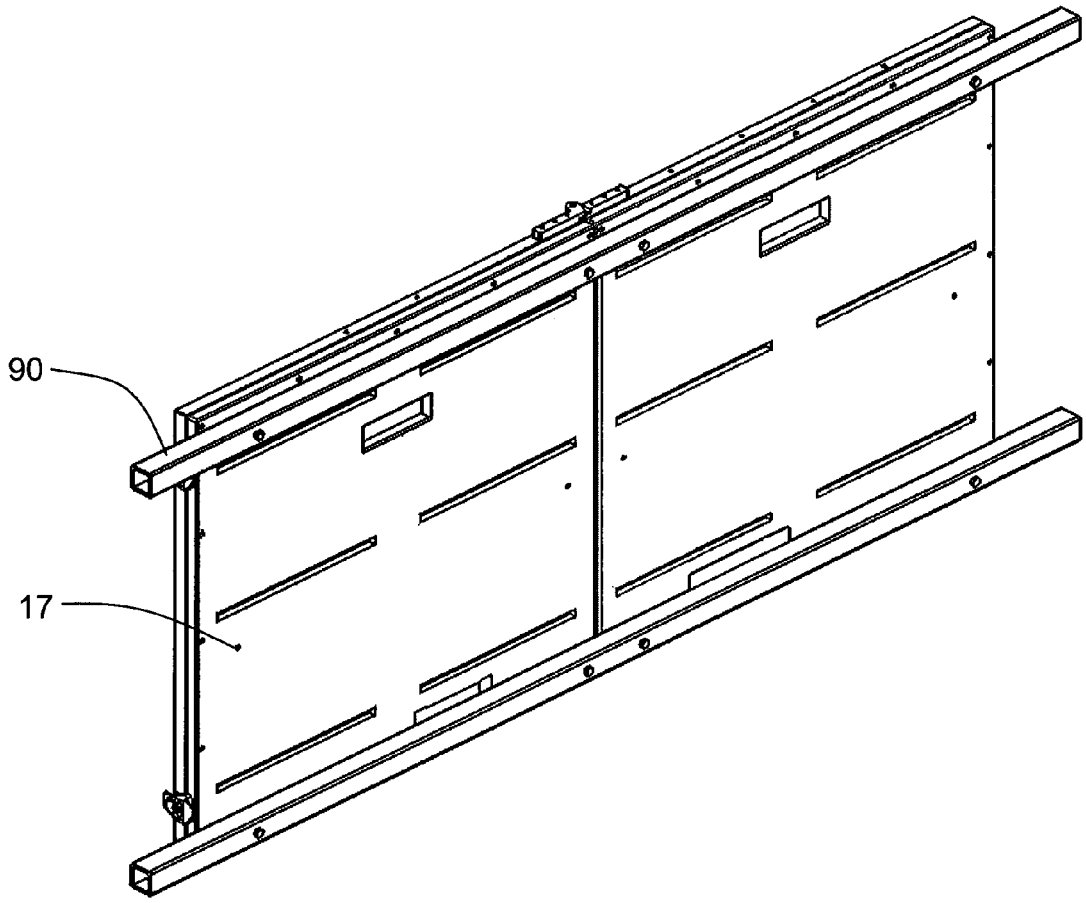
FIG. 8 is a view of the foldable electronic display attached to a mounting surface that holds it in the open orientation.

In one preferred embodiment shown in FIG. 3, a pole 36 is shown and U-bolts 38 attach the mounting bracket 22 to the pole 36. A variety of fasteners may be used to hold the mounting bracket to a surface or pole, including lag bolts and straps. The U-bolts 38 are secured to a surface or pole with nuts or similar fasteners 40 within a recessed pocket 42 of the vertical member 200 of the mounting bracket 22 before the foldable electronic display 10 is attached to the mounting bracket 22. Additionally, as shown in FIG. 8, the electronic display can be attached with mounting holes 17 built into each display panel of the foldable electronic display directly to other types of brackets 90, that allow for easy attachment of the display 10 to buildings, doors, hitch mounts 70, or other vehicle parts or surfaces (e.g. flat and sloped) and a multiplicity of other surfaces. When mounted using these mounting features 17, the sign may be held inherently in its open orientation without any additional hardware. These surfaces could additionally include, for example, a truck mount bracket the allows the sign to pivot 90 degrees for travel and display, a custom bracket structure, a vehicle door, vehicle roof, vehicle tailgate, inside of a vehicle trunk lid or top of a vehicle trunk lid.

With the mounting bracket 22 secured to the pole 36 in this example by way of the U-bolts 38 and its associated nuts or fasteners 40, the foldable electronic display 10 is attached to the mounting bracket 22 and the display 10 acts as a cover over the mounting bracket's 22 recessed pocket 42. Access to the U-bolt nuts 40 or alternate fasteners is therefore prohibited. Finally, by locking the folding electronic display 10 in place as shown in FIG. 10, unauthorized access to the mounting bracket's 22 mounting hardware to the pole 36 or other surface is prohibited. The mounting bracket 22 can be pole 36 or trailer mounted, and the same foldable electronic display 10 can be mounted on a trailer or on a pole.

The mode of operation for mounting is as follows. The operator mounts the mounting bracket 22 with hardware. The mounting bracket is bolted to a pole 36 or other surface, held with U bolts 38, strapped to the pole or attached with a multitude of other fastening devices. The hardware is installed so that the removable fasteners 40 (e.g., nuts on the U bolts or nuts on carriage bolts) are on the foldable electronic display side of the mounting bracket 22 in the recessed pocket 42. The unit is installed on the mounting bracket 22. The removable hardware is mounted in the recessed pocket 42 of the mounting bracket 22. Installing the display on the mounting bracket 22 covers the pocket 42 that holds the fasteners 40 and totally encloses the fasteners in a compartment that is not accessible to an unauthorized user.

This method of securing the foldable electronic display 10 can be used with other types of displays or message signs as well. The method can be generically described as a mounting method that allows the user to install a unit and keep it tamper proof with at least one lock by using the unit as a cover over the mounting system's hardware. The mounting system includes a mounted unit, a mounting plate and the hardware that attaches it to a pole or other surface. This mounting method also allows the user to relocate the unit easily from one location to another.

Having the display fold into multiple display panels requires the local controller's 4 signals to be communicated to the multiple display boards 6 of each display panel of the electronic display. The electronic block diagram can be seen in FIG. 7. The local controller 4 is performing software operations via an onboard microprocessor, conditioning the power for the control electronics, providing data for the display boards by decoding the message files and instructing the display boards what to display, providing communication connections and processing communications with the external devices such as the PDA or electronic computer and receiving and processing signals from the on-board controls. To avoid crimping and breakage of the folding electronic display panels' connective electronic cabling, one preferred embodiment of the present invention uses a daisy chain type wiring harness 44 (FIG. 6) that is external to the fold area 20 of the display panels. The wiring harness 44, is a multiconductor cable or a protective sheath containing a plurality of heavy-duty connectors along its length. The connections of each display panel connector 46 are universal and, as such, are electrically parallel. Universal electrical connectors along the cabling lengths allow the user to plug any connector into any display panel receptacle and still be assured intended operation. Moreover, such configuration advantageously guarantees against "mis-wire" and associated failures resulting therefrom.

In one preferred embodiment, the first section 52 of the daisy chain type wiring harness 44 contains wires for delivering power from a power source to one display panel. The power comes into the unit via the connector 46 and is transferred to the local controller 4 with wires. Power is then conveyed to additional display panels through the remaining sections of the wiring harness 54 and additional connectors 46'. The power wires are either connected for multiple runs within the connector, or on connectors external to the connector residing within the electronic display. The sections of the wiring harness 54 of the wiring harness 44 between the display panels also contain data communication wires that interconnect each of the display panels. The data is processed by the local controller 4 and fed into the daisy chain data wires with wires from the local controller 4 to the connector 46.

Figure 4:
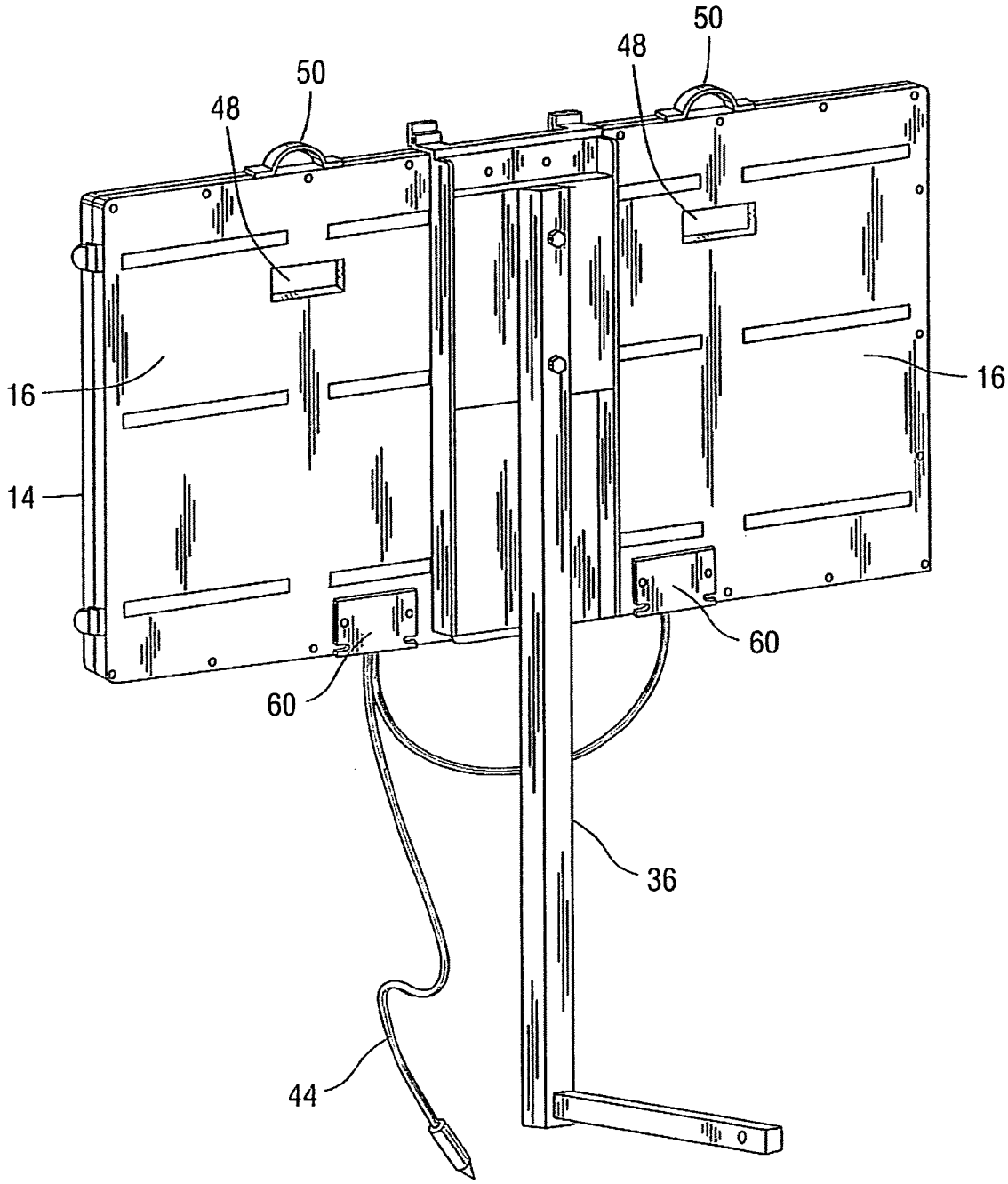
FIG. 4 is a rear, isometric view of a foldable electronic display mounted to a receiver hitch pole.

In operation, the user configures the display panels of the foldable electronic display in their operable and typically fully-opened orientation and connects the wiring harness 44 (if not already in place) between each of the multiple display panels. When connected and powered, a physical data communications connection is established between the circuitry within each of the display panels. Furthermore, the first display connector 46 of the wiring harness 44, which allows connection to the power wires, is then connected to a suitable power source, typically a vehicle cigarette lighter receptacle or an external power supply with connector 43. By externally routing the wiring harness 44 around the fold area 20 and thus allowing more freedom of movement, damage to the wiring harness 44 is eliminated due to bends of small radius. In this way, the present invention protects against wear, degradation, crimping and breakage which would otherwise result from repeated bending of the electronic cabling interconnecting circuitry routed through the area of the fold 20. A flush pocket 45 with a cover 60 (FIG. 1) in each frame member 14, 16 (FIG. 4) is used to protect the connectors, avoiding the need to remove the cabling from the display when stored.

In the event electronic connective cabling is compromised, the externally located wiring harness 44 enables simple and inexpensive replacement, eliminating the need to return the foldable electronic display 10 to the factory for repair.

While a daisy chain type wiring harness 44 external to the foldable electronic display's 10 fold line 20 is featured in one preferred embodiment of the present invention, an internal wiring harness or alternative means of communication, without an external harness 44, may be utilized consistent with the intent of the present invention.

In one preferred embodiment of the present invention, text and graphical messages are formed on the electronic message surfaces 12, 12' by illuminating certain illuminable pixel elements contained within an array of illuminable pixel elements. Message formation on the display panels using illuminable pixel elements, described herein, is well known to those in the art of electronic displays and the precise method of forming the array of pixel elements is not critical to the present invention as any number of methods known in the art can be used. Pixel elements, in one preferred embodiment, are mounted on electronic circuit boards well known to those in the art. This is done in a conventional manner of electronic circuit board design and construction. The pixel elements of the display panels of each electronic message surface 12, 12' may be one of many types including plasma, liquid crystal, incandescent, or preferably, LED. For traffic applications, a pixel density of approximately one pixel per inch is acceptable. However, the pixel density can be much higher or lower to ensure that the foldable electronic display 10 is clear in its intended application.

Each pixel element may be accessed with a column and row addressing scheme well known to those in the art. Pixel elements may be arranged in logical sets, and whose column and row addressing is consistent with the technology of the controlling signals driving the pixels. By scanning across all columns for concurrently accessed row, any individual pixel may be controlled independently. Multiple sets, contiguously placed, give the appearance of one large array structure. Text or graphic data may be parsed along logical pixel grouping boundaries and displayed accordingly.

Figure 6:
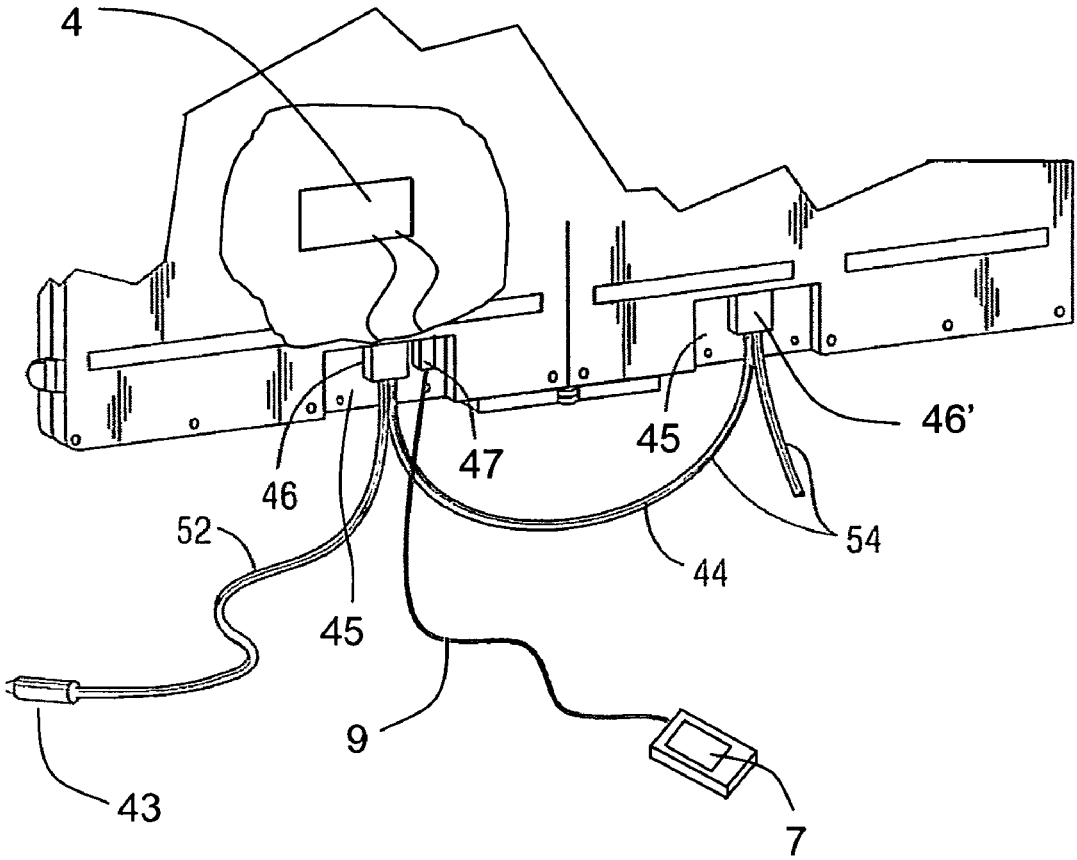
FIG. 6 is a rear elevation view showing a wiring harness mounted external to the fold between the display panels of a foldable electronic display.
Figure 7:
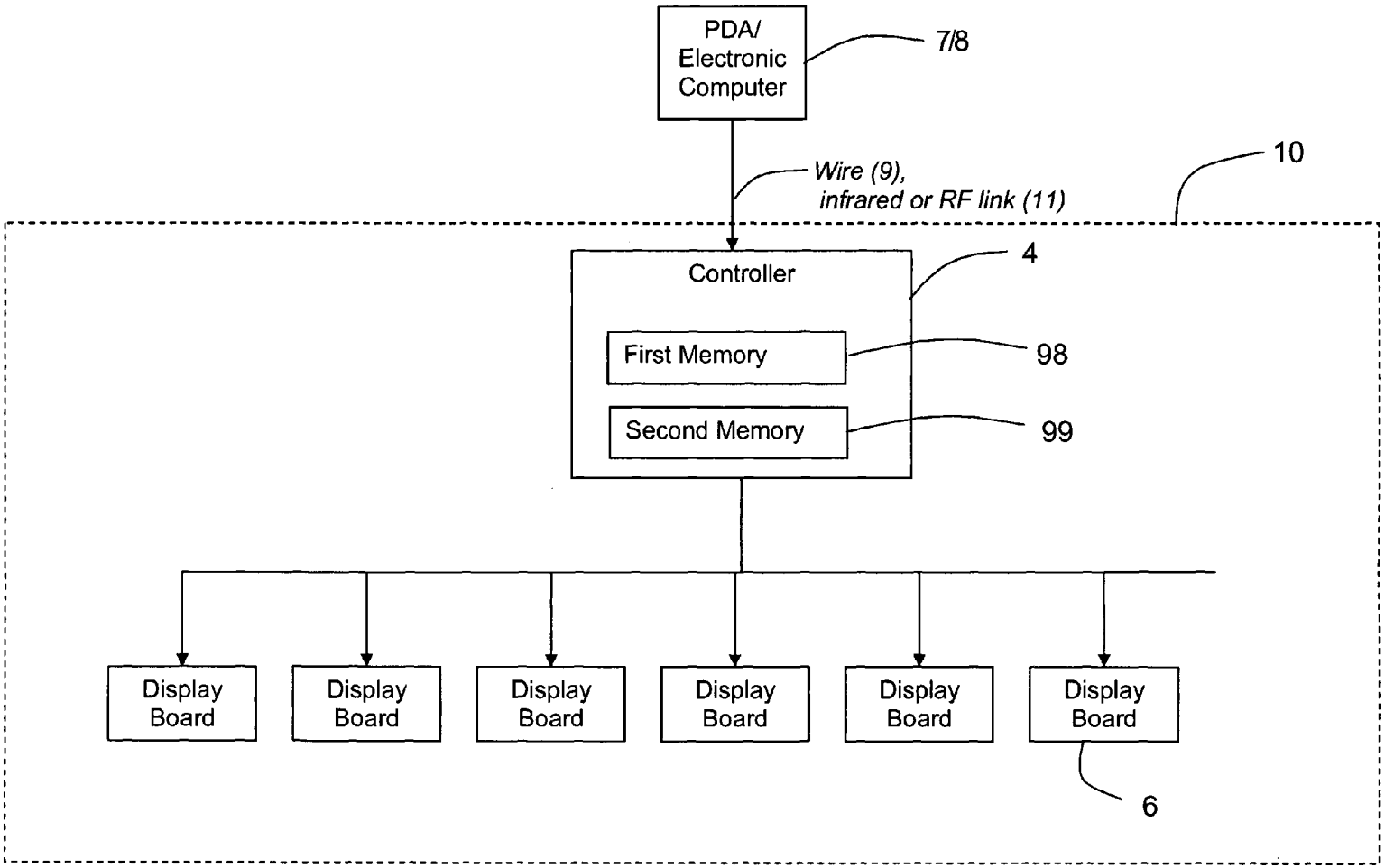
FIG. 7 is an electrical block diagram of the foldable electronic display.

Text or graphic messages may be created on a PC, Personal Digital Assistant (PDA) 7, laptop, or other electronic computer shown in FIG. 6, mobile phone, by broadcast signal, or other programming device, in close proximity or remotely from the display, using software for that purpose. The message is created with a software program written for an electronic computer or a Personal Digital Assistant 7 such as a Dell AXIM X3/X30 or other Windows CE or PALM OS handheld device.

In one preferred embodiment, the software interface for message creation on the foldable electronic display using an electronic computer makes the programming of the electronic display message simple and intuitive.

Figure 14A:
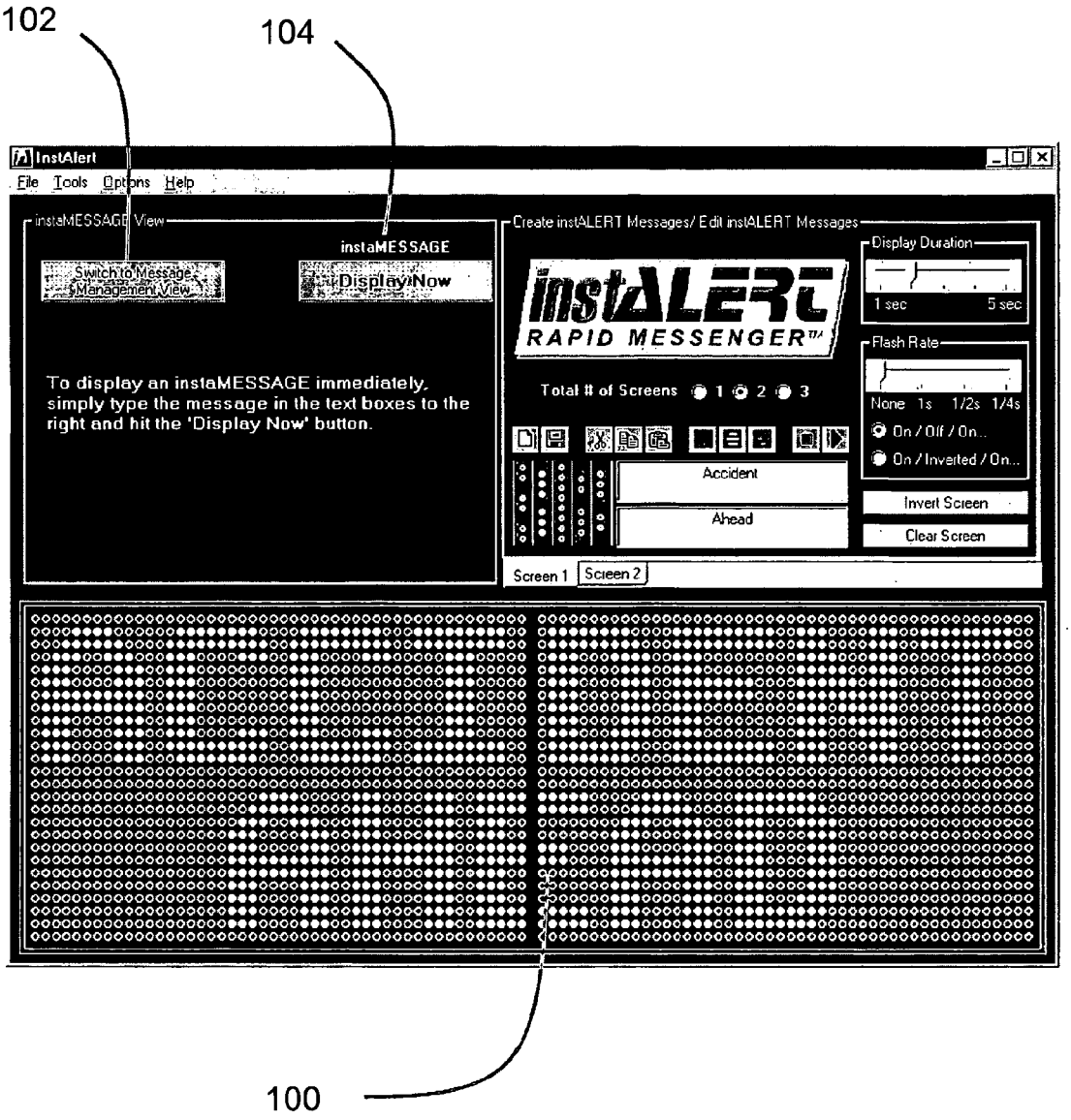
FIGS. 14A thru 14G are screen shots of the electronic display programming software.

There are two levels of complexity in the program to place messages on the electronic display. When the program is started, it will start up in the first level of simplified complexity, known as the instaMESSSAGE View (FIG. 14A.) In this first, simple level of complexity, the software shows only the functions necessary to create a new message, preview this message, save the message and display the message on the electronic display. In this view, the user creates a new message and downloads it to the electronic display. This view is intended for emergency situations that require a custom message that needs to be displayed quickly.

To display an instaMESSAGE on the electronic display, first create a message using the instructions disclosed in the second level of complexity section of this disclosure. The message will display in the preview screen 100 of the software. The message that displays in the preview screen is exactly the message that will be displayed on the electronic display 10. Connect the electronic display to the computer via a serial cable 9, infrared link or radio frequency link 11 (Bluetooth or 802.11.) Click on the 'Display Now' button 104 to load the message to the electronic display.

Figure 14B:
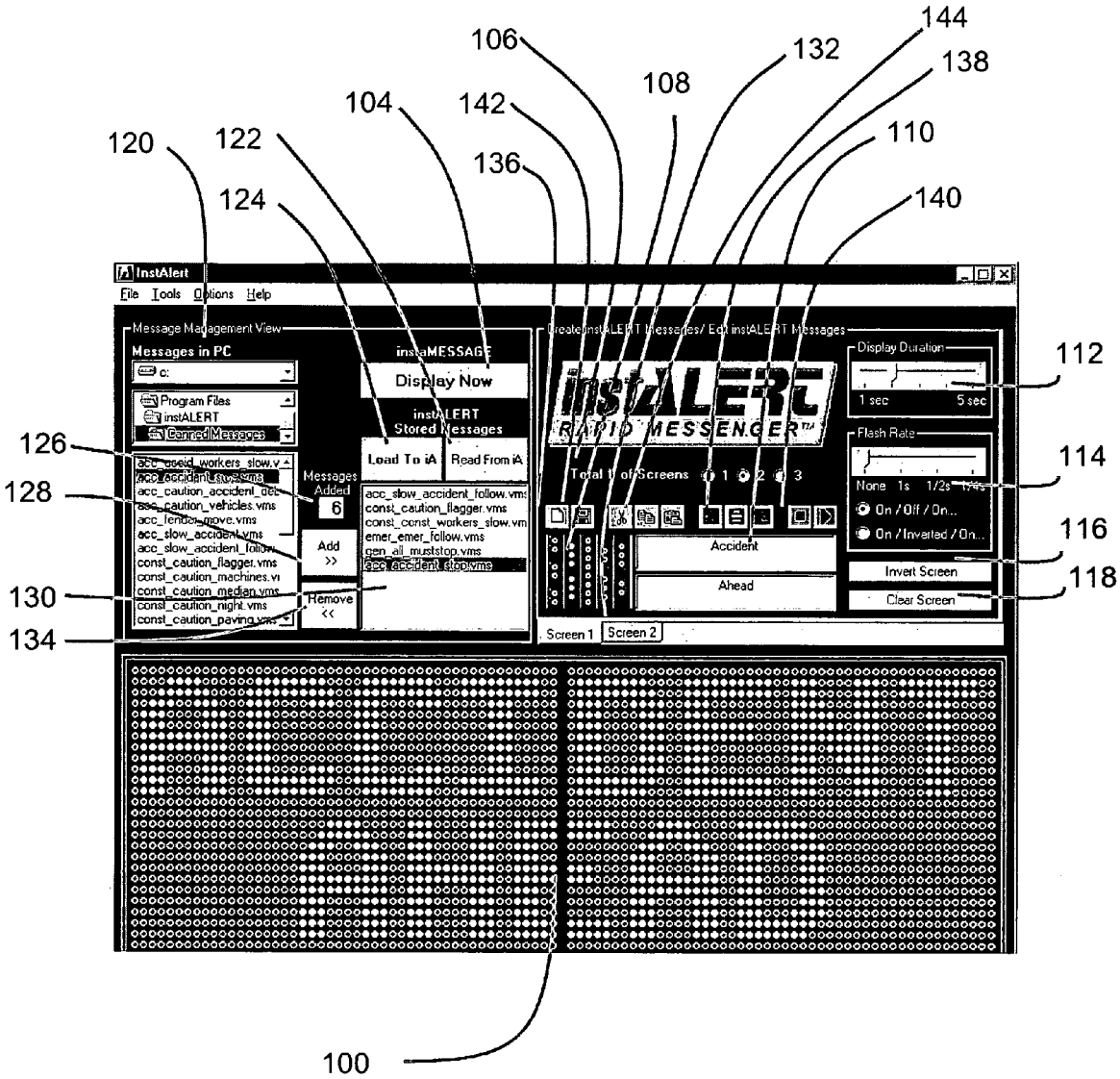

The second level of complexity, labeled the "Message Management View" allows the user to perform all of the functions from the first level and also view, locate, retrieve and edit pre-existing messages from the computer. This view allows the user to load multiple messages to the electronic display's primary memory or first memory and to store default messages to the second memory of the display. It is entered by clicking the "Switch to Message Management View" button 102. Refer to FIG. 14B.

On the left part of the message management view there is a set of file lists. The file list on the left marked "Messages in PC" 120 shows the files or messages stored on the electronic computer and the location they are stored. In the right box marked "instALERT Stored Messages" 130 are the files or messages that are currently stored in the electronic display 10 or messages that will eventually be sent to the display. Select messages to be stored in the electronic display's primary memory from the list on the left. Click "Add >>" 128 for each message to be added the electronic display message list or "Remove<<" 134 for each message to be removed from the electronic display. As messages are added, a counter 126 keeps track of the total. When the capacity of the electronic display's first or second memory is reached, the shading behind the message count number turns red or the software does not let the user add any more messages to the list to indicate that the limit has been reached. This first or second memory limit is set at 24, simply to keep the number of messages in the electronic display manageable. It could be more or less with simple software modifications. Connect the electronic display to the computer via a serial cable 9, infrared link or radio frequency link 11. To load the selected messages into the primary memory of the electronic display, press the "Load To iA" button 124. The messages will download to the electronic display. To load default messages (messages stored in a second memory location that can be accessed at any time if signs are inadvertently lost) to the electronic display, move messages into the "instALERT stored messages" window 130 as done for the primary memory messages, but simultaneously press the Shift key on the electronic computer keyboard and click the right mouse button on the "Load to iA" button 124.

The user can also download the messages from the electronic display into the electronic computer for review and editing. Press "Read from iA" button 122 and the messages in the primary memory on the electronic display will load into electronic computer and be visible in the "instALERT Stored Messages" window 130. The list can be edited and the messages saved on the electronic computer or reloaded to the electronic display 10 with any changes desired. To read the default messages in the second memory from the display, simultaneously press the Shift key on the electronic computer keyboard and click the right mouse button on the "Read from iA" button 122. The messages in the second memory on the electronic display will load into the "instALERT Stored Messages" window 130. The list can be edited and the messages saved on the electronic computer or reloaded to the electronic display with any changes desired.

To create a new message, the operator determines the message to display, such as "SLOW/ACCIDENT AHEAD/TAKE NEXT EXIT." Refer to FIG. 14B. Start a new message by clicking on the 'New Message' button 136. Next, select the number of screens, or sequencing displays, for the message using the "total number of screens" selections 106. Click on the appropriate number of screens, which in this example is three. One, two, or three tabs 132 will become visible above the display, one for each screen of the sequence. The tabs correspond to each screen the electronic display will display.

Click on the 'Screen 1' tab. On each tab there is a group of tools that will allow configuration of the message. The first tool is the text lines and size tool 108. This tool selects the size of text for each line of the message from three sizes: small (2 dots for each line) for three lines of text, medium (3 dots for each line) for two lines of text, or large (8 dots for the single line) for one line of text. There are also selections for one small and one medium line of text, either with the medium line above or below the small line. As the different text size choices are made, the text boxes 110 for the user to fill in change accordingly, both in the number of boxes corresponding to the number of lines and the size of the box corresponding to the size of the text.

For the first screen of this example, click on the "Screen 1" tab. Choose the large text by clicking on the column showing 8 dots. The display will now show one text box in which to type the first screen. In the box, type "SLOW." As the text is typed, it will show up in the preview screen 100. The preview screen displays the text exactly as it will show on the electronic display. Go to the "Display Duration" window 112 and move the slider bar to the 3 seconds notch, for example, which will make this screen display for 3 seconds. Finally, select any display effects for this screen of the display using the "Flash Rate" window 114 to select options such as flashing on-off or reversing—normal and the rate of flashing or reversing.

For the second screen of this example, click on the "Screen 2" tab. Choose the medium text by clicking on the column showing 3 dots for each line. The display will now show two text boxes in which to type the second screen. In the top box, type "ACCIDENT." In the bottom box, type "AHEAD." Click the text center justify button 138 to center the text. Alternately, the left or right justify buttons 138 can be selected to manipulate the text position to the left or right. As for screen 1, select screen duration and desired display effects for this screen.

For the third screen of this example, click on the "Screen 3" tab. Choose the small text by clicking on the column showing 2 dots for each line. The display will now show three text boxes in which to type the third screen. In the top box, type "TAKE." In the middle box, type "NEXT." In the bottom box, type "EXIT." Click the text center justify button to center the text. Alternately, the left or right justify buttons can be selected to manipulate the text position. As for the other screens select screen duration and desired display effects for this screen.

It can be understood that there could be an unlimited number of sequenced screens making up a complete message. For purposes of this disclosure, we have limited the example to three.

By using the play buttons 140, the message can be previewed in the preview screen 100 at the bottom of the screen, until the preview is stopped by clicking the "stop" button. Each screen can be individually reviewed by clicking on the screen tab for each screen.

To save a message click the 'Save' button 142 on any of the screen tabs, or choose the 'Save' or 'Save As' options under the 'File' menu. The 'Save As' screen will appear prompting the user to type a file name and select a location to store the file on the electronic computer. The user enters a name and clicks the 'Save' button.

The software contains the following features for making message creation and editing easy. The Cut, Copy and Paste buttons 144 work like other windows applications. When pressed, the current screen will be cut, copied, or pasted over. For example, to move the screen 1 to screen 3 the user will do the following:

1. Click "Screen 1"
2. Click "Cut" (the scissors icon) and your message will disappear (Alternatively, Copy will copy the message but leave it on the screen)
3. Click "Screen 3"
4. Click Paste (the clipboard icon) and your message will appear on Screen 3.

The user can make each screen flash while it is displaying using the "Flash Rate" window 114 selections as discussed previously. The first way of doing this is On/Off/On, which will display the screen for the length of time chosen in Flash Rate and then display a blank screen for the same time period. For example, if a message is displayed with a flash rate of ¼ second, the screen will be on for ¼ second, then it will be off for ¼ second until it hits the Display duration. If you display duration is 1 second, then it will flash on and off twice.

The second way of flashing is On/Inverted/On, which will display the screen for the length of time chosen in Flash Rate and then display an inverted version of the screen for the same time period. During the reversed time the inverted screen turns on all pixels not used in the message during the on time, creating a positive/negative image. For example, if a message is displayed with a flash rate of ¼ second, the screen will be on for ¼ second, then it will be inverted for ¼ second until the display duration time is met. Again, if the display duration is 1 second, then it will flash on and reverse twice.

The software also allows the user to manually invert the sign to preview the appearance or to manually create a reversed image with the "Invert Display" button 116. It also has a "Clear Screen" button 118 to start the message screen over with a blank screen.

Figure 14C:
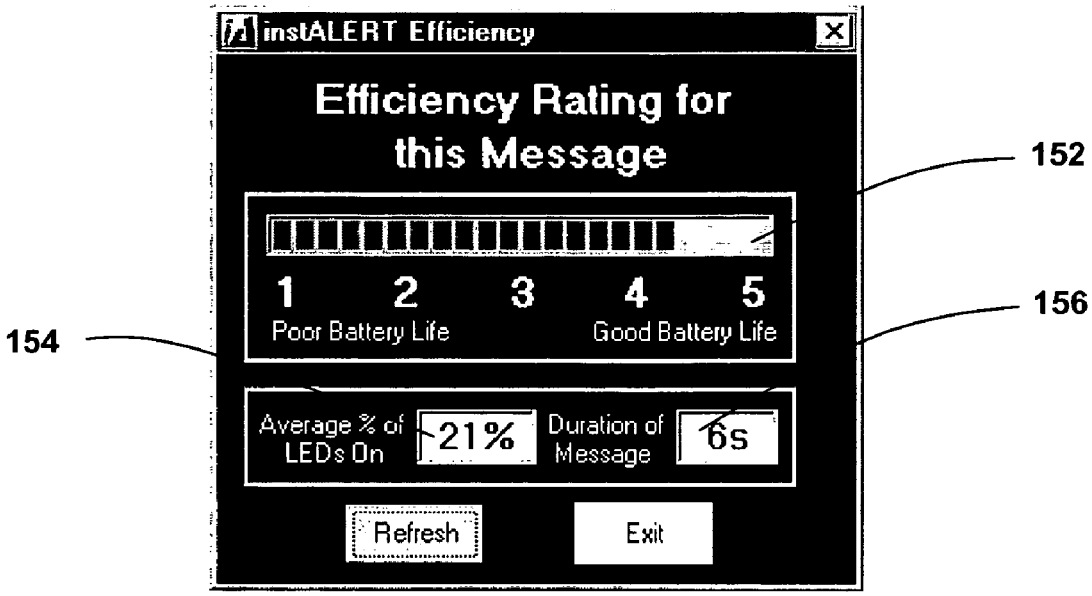
Figure 14D:
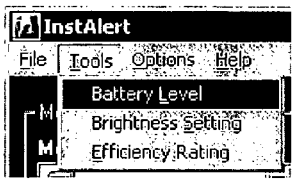
Figure 14E:
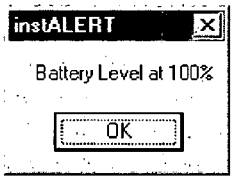

The Battery level tool allows the software to display the battery level of the electronic display's power source. Click Tools, Battery Level (FIG. 14D) and the current battery level window (FIG. 14E) will pop up.

Figure 14F:
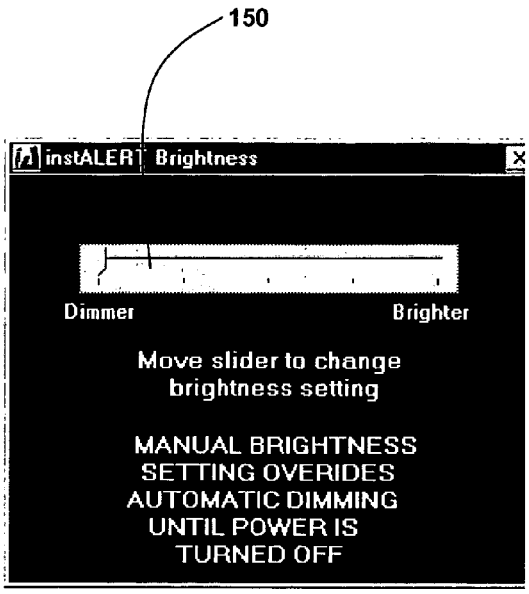

The Brightness Setting tool controls the brightness of the electronic display. Brighter is better for sunnier days, and dimmer is better for battery life. At night, the dimmest setting is ideal and will make the battery last longer. This manual setting overrides the display's automatic brightness control that adjusts the display brightness according to the surrounding ambient light automatically. The manual override stays in effect until the power is removed from the sign. Click Tools, Brightness Setting (FIG. 14D) and the current brightness level window (FIG. 14F) will pop up showing the current level and with a slider bar 150 for selecting a different setting and allowing this to be sent to the electronic display.

The Efficiency Rating Tool shows the estimated efficiency rating for the message currently being created or edited. The more pixels illuminated in a message and the longer the duration of illumination the less efficient the display will be in using the available battery power. The goal for the user is to get the maximum efficiency rating while communicating the necessary information, which translates into the longest possible duration for the power supply before recharging. Click Tools, Efficiency Rating (FIG. 14D) and the efficiency ratings window (FIG. 14C) will pop up with the efficiency of the current message 152. It displays a 1-5 efficiency rating, shows the average number of LEDs on 154 and the total duration of the LEDs 156 taking into account display durations and flash rates.

Figure 14G:
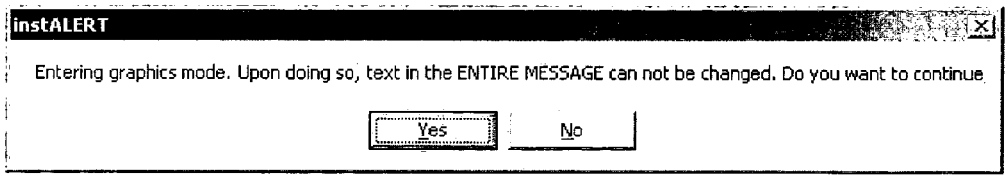
Figure 15A:
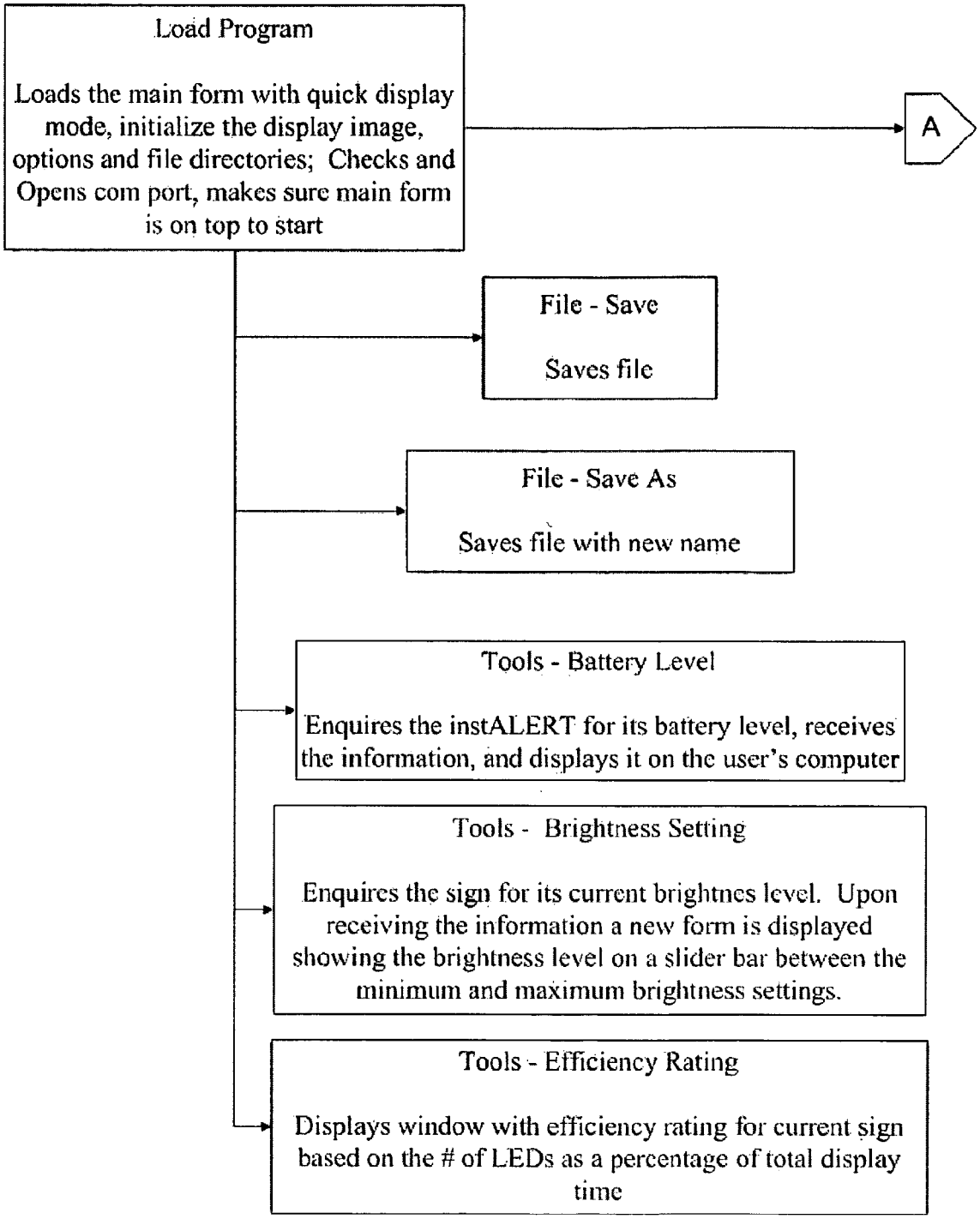
FIGS. 15A-15J, taken together, is a flow chart of the electronic display programming software.
Figure 15B:
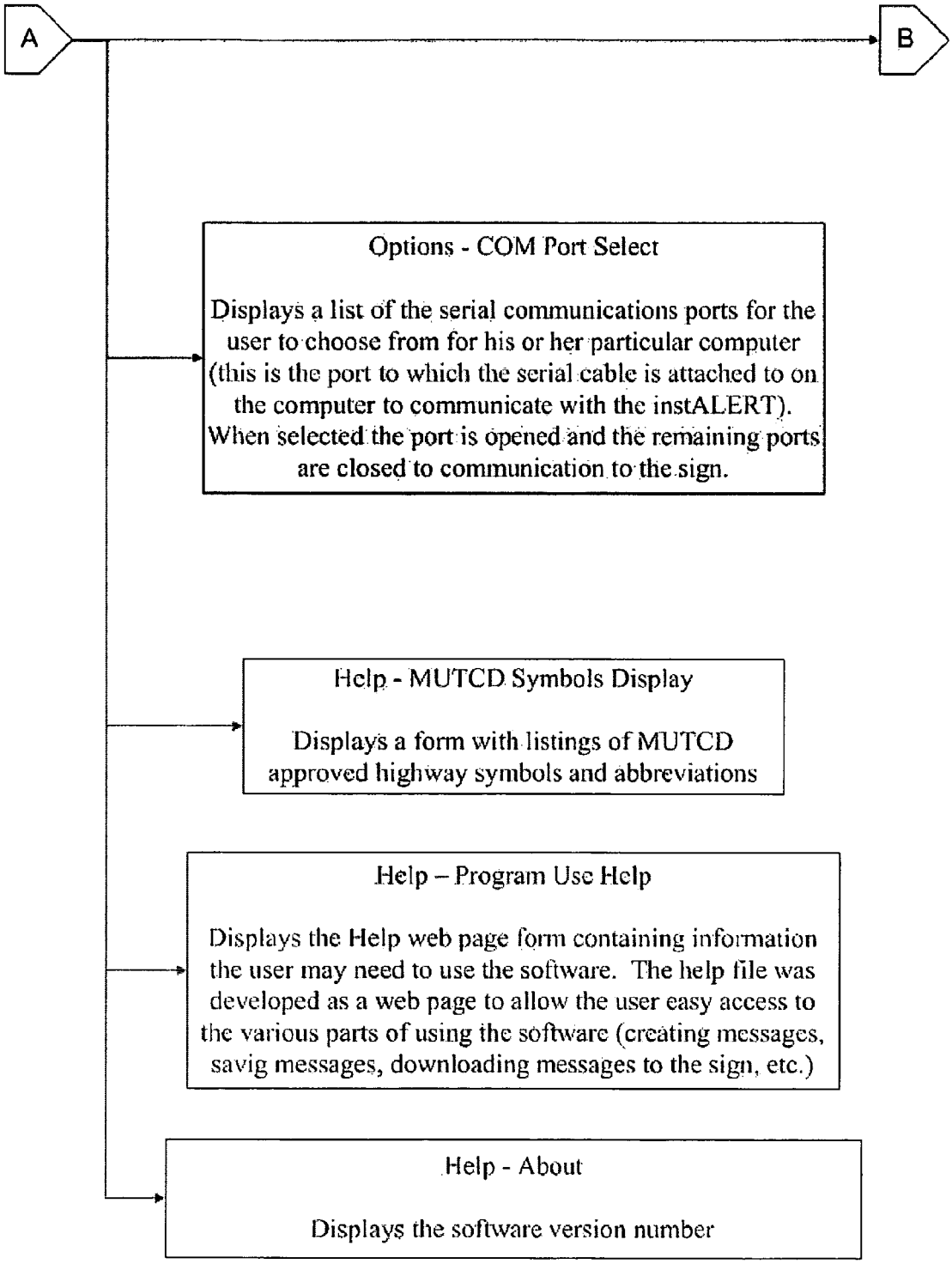
Figure 15C:
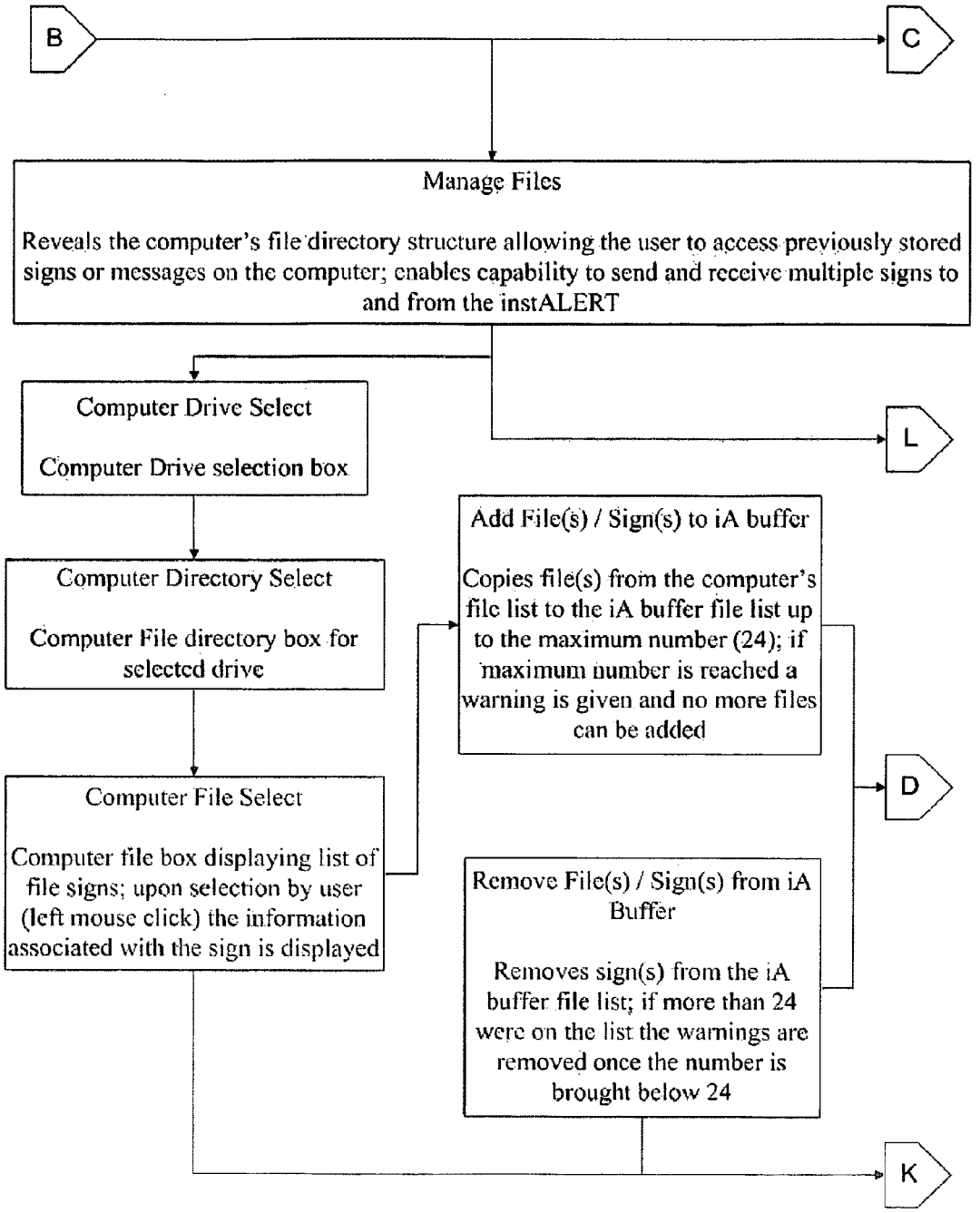
Figure 15D:
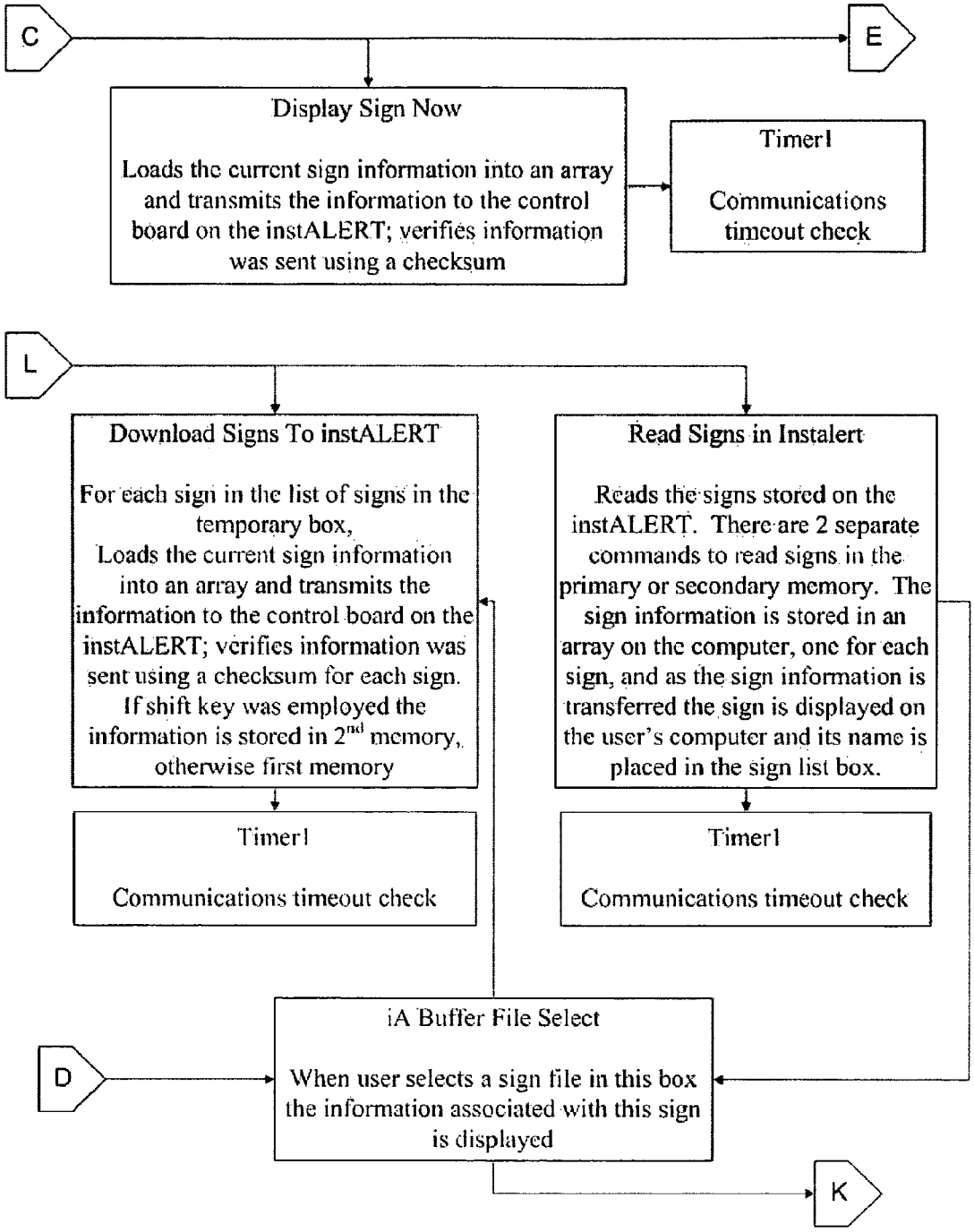
Figure 15E:
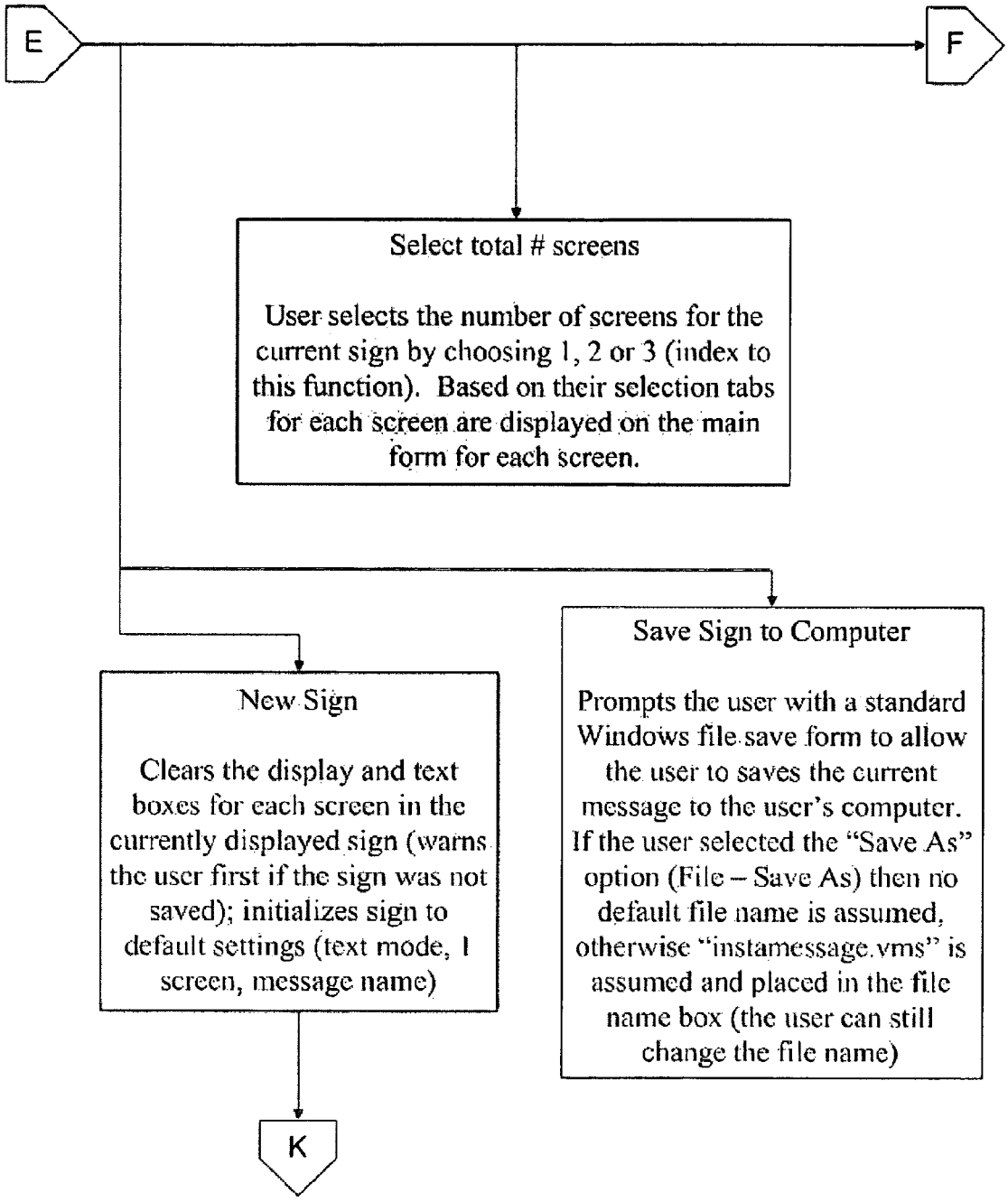
Figure 15F:
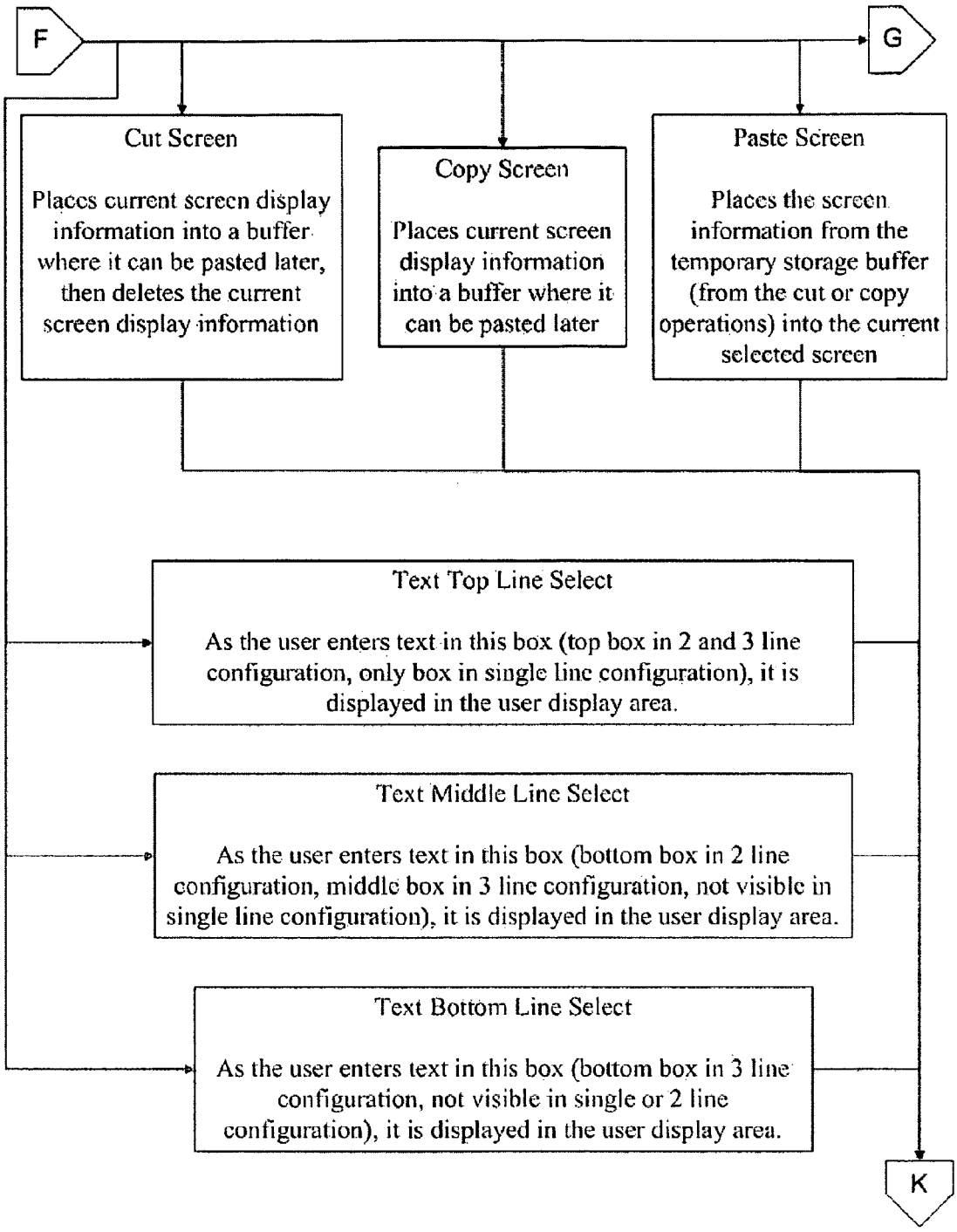
Figure 15G:
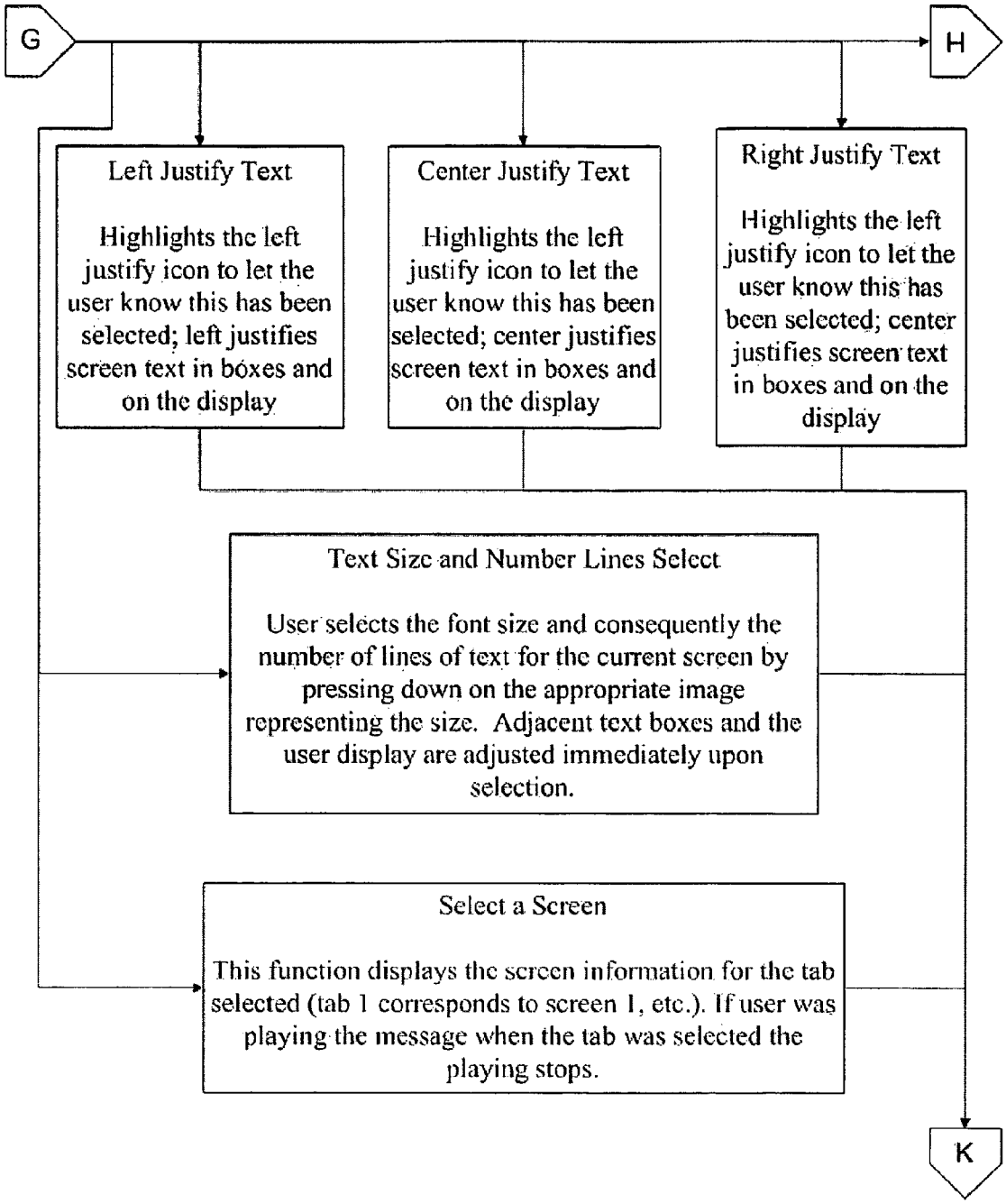
Figure 15H:
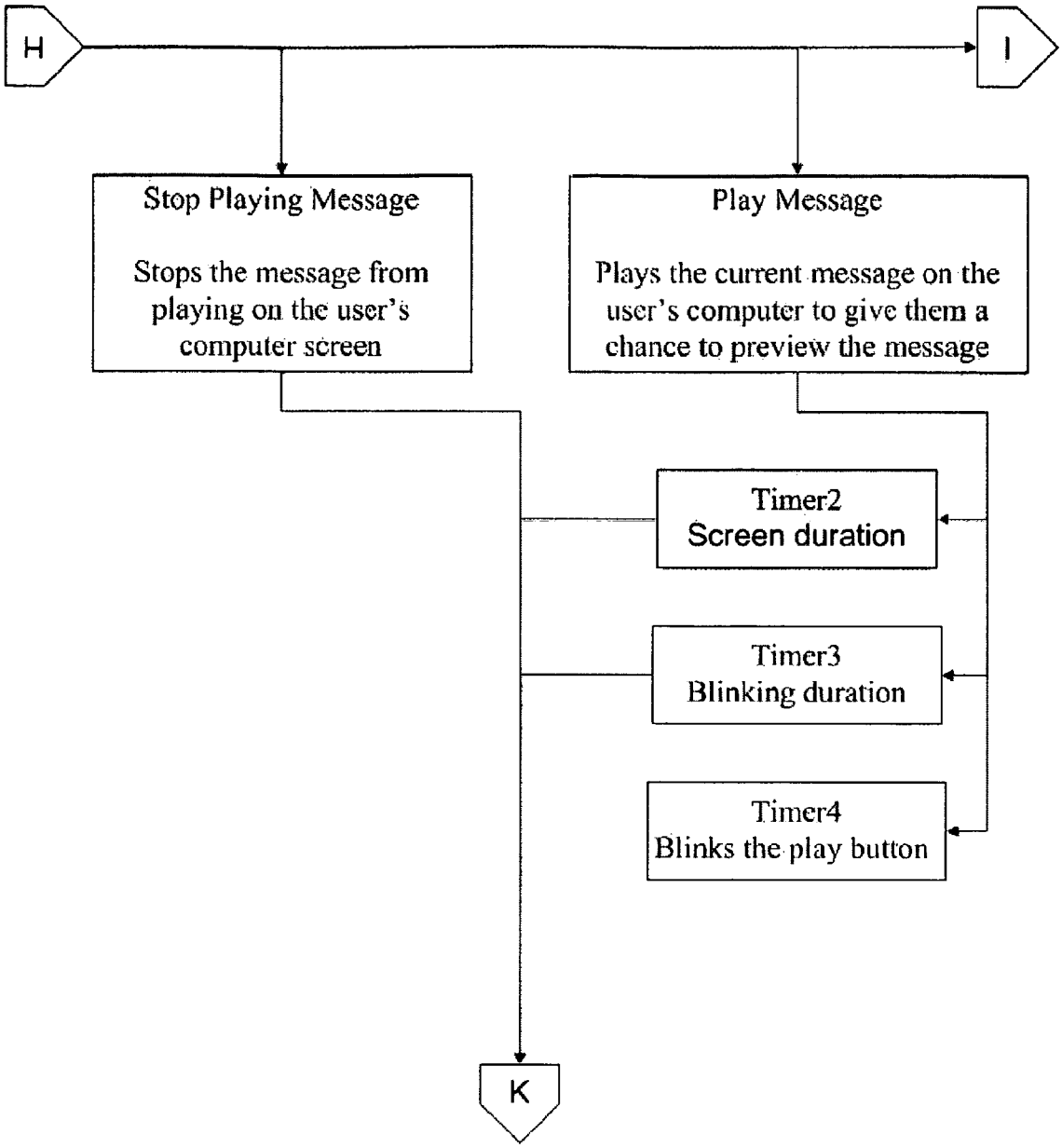
Figure 15I:
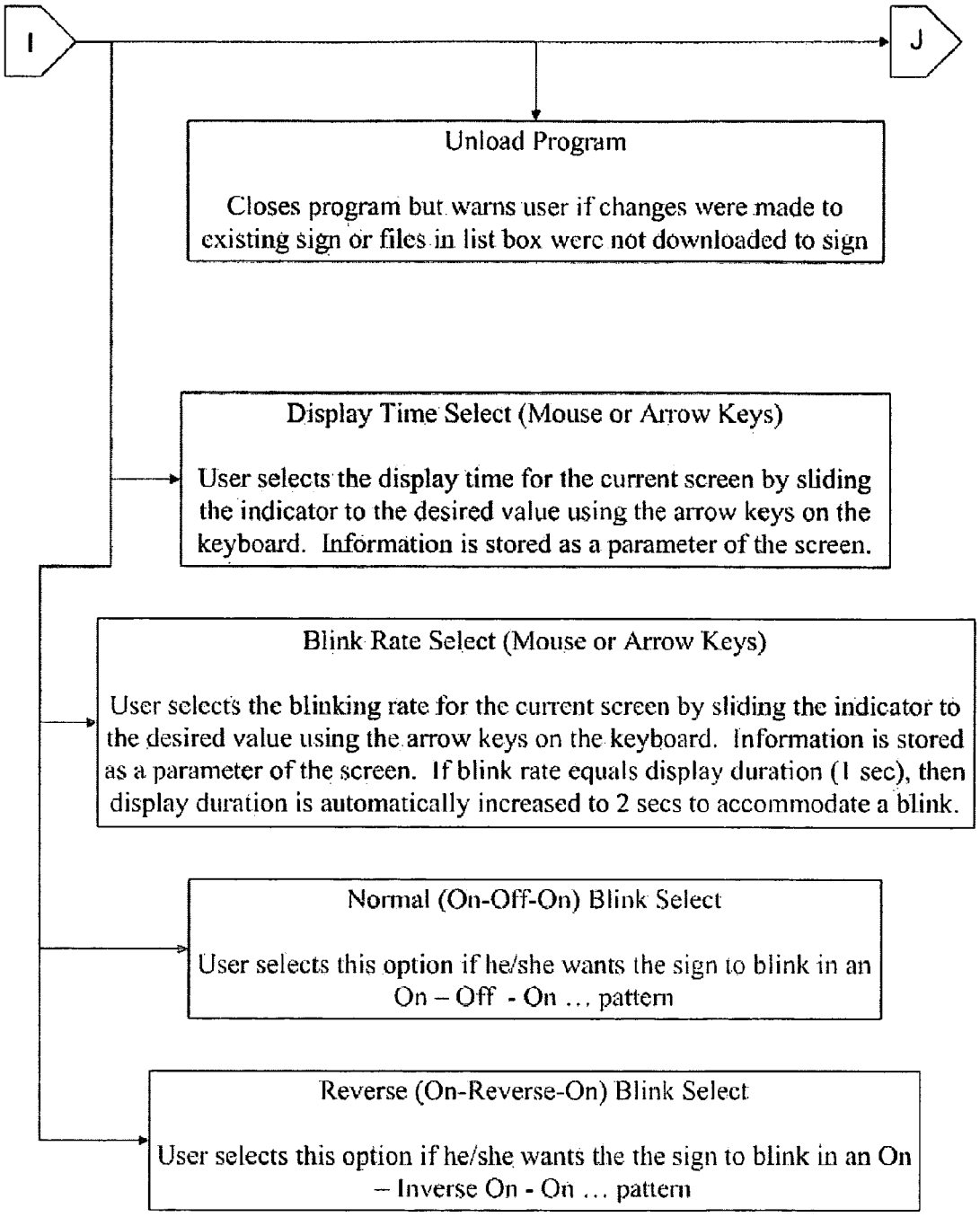
Figure 15J:
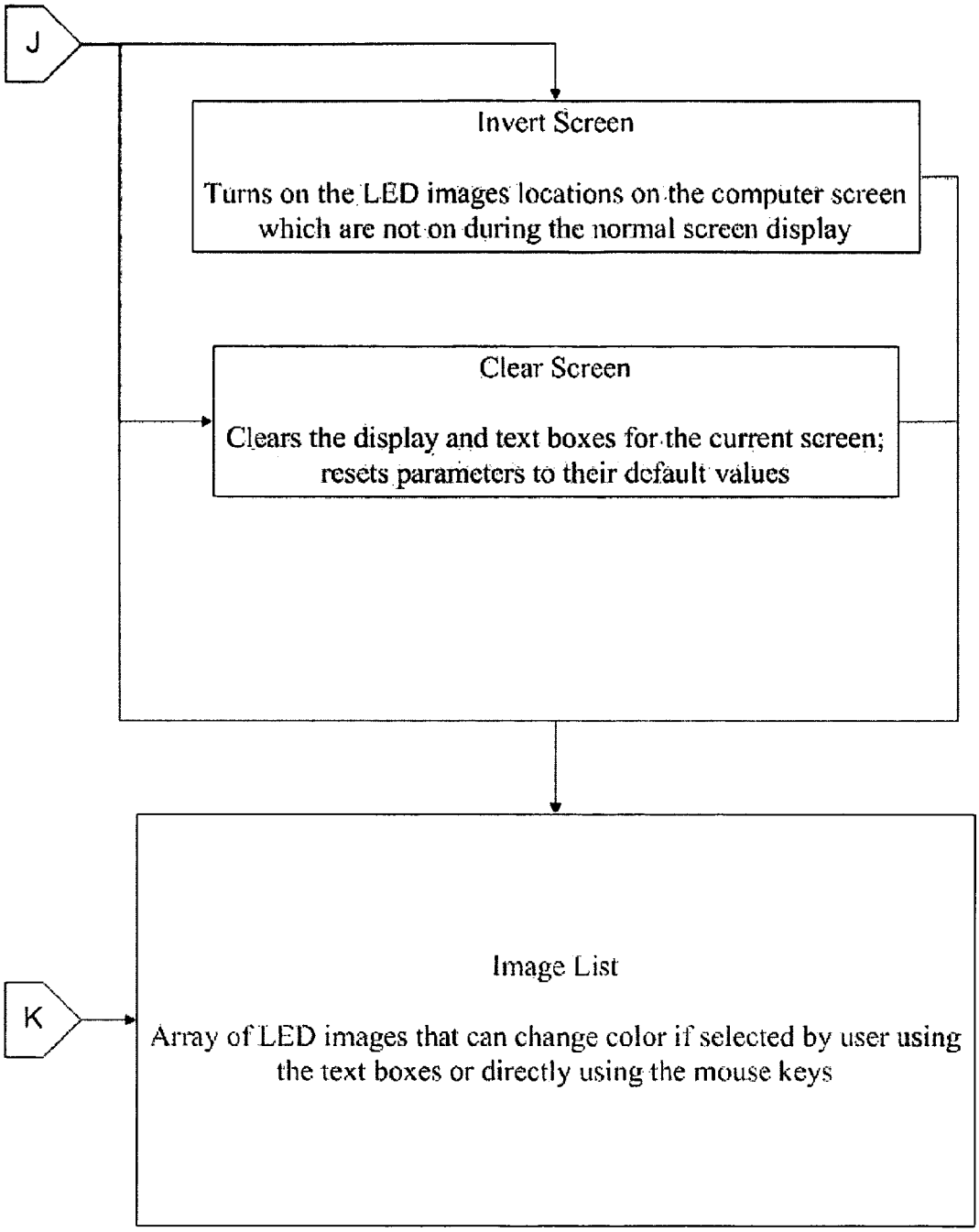

The electronic display also allows the creation of a message with graphics. Graphical messages are drawn with the computer mouse. Click on the display screen on the software to enter Graphics Mode. Once the software enters graphics mode, the user can no longer edit any of the three screens using the text entry tools. A notice, FIG. 14G, indicates this to the user. Using the left mouse button, the user can turn on any of the pixels in the display. With the left mouse button pressed, the mouse can be dragged across the pixels and illuminate all pixels it contacts. Conversely, by pressing on the right mouse button, the mouse can be dragged across the pixels and erase all pixels it contacts. The user has complete control over all pixels on the display. The individual pixels on the software display correspond directly to the individual pixels on the electronic display.

To preview how the message will look on the sign with the display durations, flash rates and screen sequences, do so by pressing the PLAY button. The speed the signs will display varies with the individual computer speed and settings. Actual timing on the electronic display is more accurate, and play mode is only intended to give a good idea of how the full message will appear.

The PDA software has all of the features found in the electronic computer software except for the creation of graphical messages. Graphical messages, created on an electronic computer can be stored, previewed and loaded to the electronic display from the PDA. The PDA has a message tab which allows the user to create a message in the same way as done on the electronic computer software. It offers the number of screen selection, the current screen selection, multiple text rows and sizes, text justification, screen duration and flash rate. It also allows previews of the massage and a "Display Now" button to send the message directly to the electronic display with any one of the previously disclosed communication methods. The software also allows the user to "Get Current Display" which downloads the message that is currently being displayed on the electronic display. This is beneficial if a user is in their car while the electronic display is mounted on the back of the vehicle out of their field of vision.

On the PDA software "File Management" tab, the user can select messages from the PDAs memory to edit, display now on the electronic display or create a list of messages to send to the first or second memory of the electronic display. It also allows the user to download the messages currently stored on the electronic display, either in the first or second memory location.

On the PDA software "tools" tab, the user can check the battery level, check and set the brightness level and scroll through the messages, just as the switches on the electronic display will do. There is no software lockout of the scroll buttons on the PDA as there is on the on-board controls.

FIGS. 15A-15J, taken together, is a self-explanatory flow chart of the electronic display programming software.

The message data may be transferred via a communication link, such as a serial connection from a programming device, to a local controller 4 integral to the foldable electronic display, typically a microprocessor or microcontroller, where it is parsed and displayed. The communication link may be, for example, a cable 9 with a connector 47 to the electronic display 10 (FIG. 6), cellular connection, infrared or radio frequency 11 (FIG. 7) communication link. Preferably, the local controller 4 is integral to or protected within the foldable electronic display 10 to allow for higher reliability and easier set up. Alternatively, message data may be downloaded and distributed directly to electronic microprocessors on the internal display board 6 sets via their interconnecting network wires 5.

Multiple text or graphic message data may be downloaded to the local controller 4 and stored in RAM or flash memory. The untethered programming device 7, 8 of the present invention allows a plurality of preprogrammed messages to be conveniently created, reviewed or modified both with or without the foldable electronic display 10 connected. With the foldable message display connected with the wire communication link 9 or wireless communication link 11 these messages may be uploaded to the primary memory or first memory. On-board controls 64 (FIG. 2), resident on the foldable electronic display 10, for example push button switches, which may scroll through the stored messages, may be provided allowing specific selection of text or graphic messages to be displayed from the first memory. Moreover, a set of preprogrammed messages in the first memory 98 on the local controller 4 that are over written overwritten as a result of improper action by a user such as uploading a group of blank messages can be replaced by another group of user programmable default messages stored in a second memory 99 on the local controller 4 within the display without the need for an external programming device. These may be accessed through a programmed series of switch closures utilizing the on-board controls 64 on the foldable electronic display 10.

In this way, the foldable electronic display 10 may not require an external programming device once it is configured, providing a user with complete flexibility. It will be understood that as used herein, the phrase "predetermined textual and graphic messages" refers to both factory preprogrammed and user-created custom messages. Such messages include, for example, "ACCIDENT AHEAD", "SPEED LIMT-_MPH", "MAINTAIN SPEED", "DUI CHECK", "HEAVY PEDESTRIAN TRAFFIC", and graphics such as arrows or pictures or multicolored images.

Figure 12:
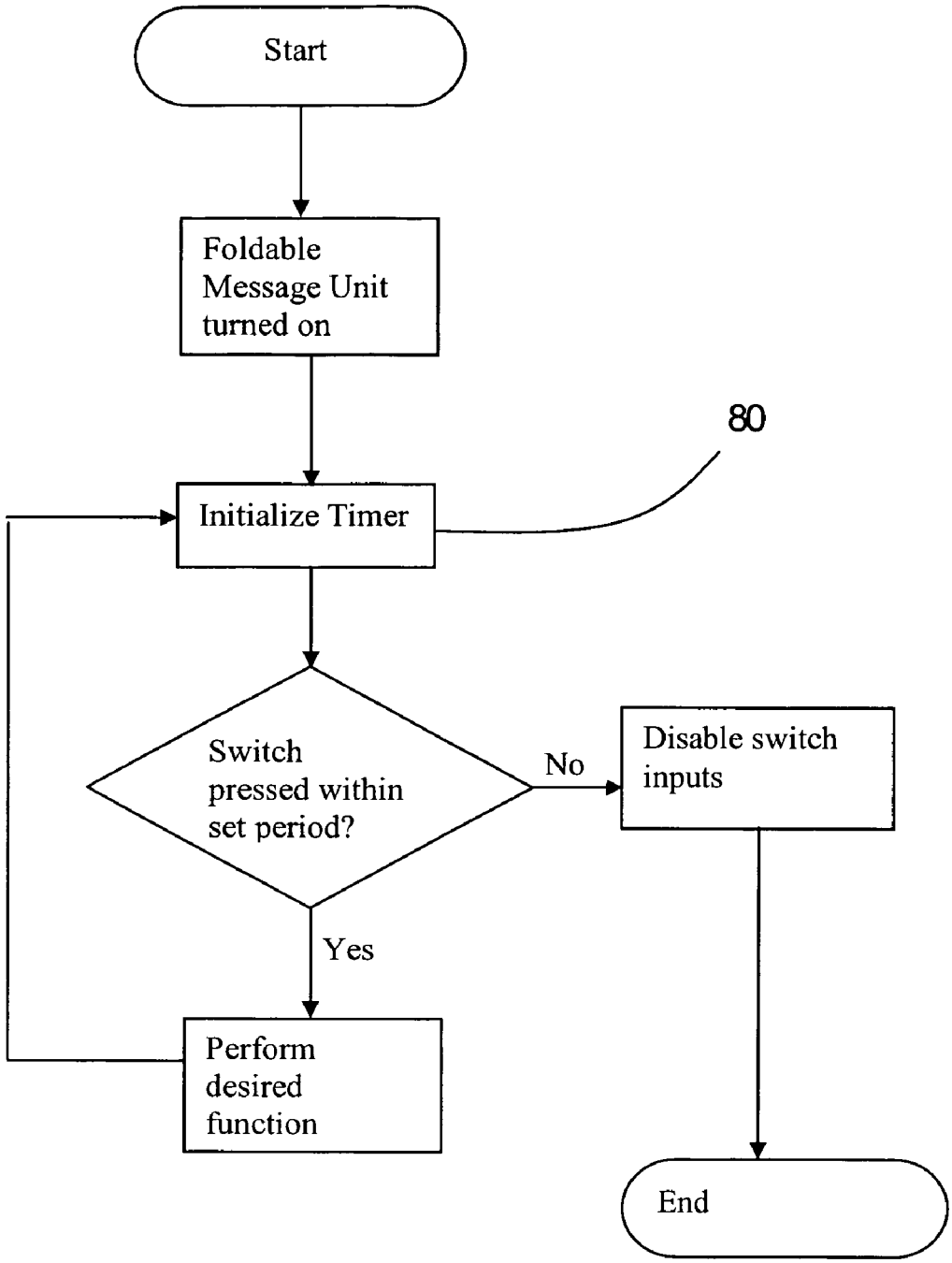
FIG. 12 is a flowchart of the software on-board control lockout feature.

In one preferred embodiment of the present invention, the aforementioned local controller 4 may contain software that "locks out" or ignores user inputs from the displays on-board controls 64. The software logic of this feature is shown in FIG. 12. The integral software on-board control lock may be set by a user command or may be activated automatically at a predetermined time after which power has been applied or inputs from the on-board controls 64 cease. This feature prevents unauthorized changes of the messages displayed on the foldable electronic display 10 when left unattended, and thereby eliminates the need to use mechanical security devices to protect the electronic display's 10 on-board controls 64.

In operation, a user may apply power to the display 10 whereupon the local controller software would initiate a software timer 80. In one preferred embodiment, for a time period less than a predetermined amount, the software allows a user to select among the various previously stored text and graphical messages by activating on-board controls 64. After the programmed time period has elapsed after start up (for example, five minutes of inactivity from the time the power is applied or the last on-board control 64 is pressed), the software locks out a user's request to change the text and graphical messages by ignoring their control inputs, typically, of the switch closure type. This low cost, automatic lock out feature allows users to leave the foldable electronic display 10 unattended without locking the unit's on-board controls 64 by mechanical means. The display 10 can be "reset", re-enabling the on-board controls, by turning power to the unit off and back on again. The source providing power to the foldable electronic display 10 can be secured to not allow unauthorized users to operate or tamper with the power to an unattended display, and most individuals who desire to tamper with the display will not know to turn power to the unit off and back on again to re-enable the on-board controls. The automatic lock out feature is particularly useful for crowd control (e.g., fairs, sporting events) where the controls may be generally within reach of the public.

The foldable electronic display 10 enables law enforcement, public works personnel, security officers, first responders, emergency management personnel, and other users to accurately and promptly communicate with the public. The foldable electronic display 10 can be used to quickly display a stored message and/or a newly created message uploaded into the primary memory at an incident. As such, the present invention is ideal for work zones, speed zones, residential areas, transportation hubs, and sporting events (e.g., crowd control), among others. In an alternate embodiment, the display 10 can be adapted to include a high density display matrix of illuminable pixel elements such that the unit essentially comprises a folding television display.

The foldable electronic display 10 enables a variety of textual and graphic messages, relating to, for example, motorist speed, Amber Alerts, accidents, DUI checkpoints, directions, road conditions, and public emergencies (e.g., security level) to be accessed and displayed without the need for a user or his/her vehicle to remain in proximity to the display 10 during operation thereof. In this way, the self-standing and remotely operable display of the present invention affords the user complete flexibility in display positioning. When not in use, the display 10 may be stowed in the luggage compartment of a vehicle in a folded orientation, for easy retrieval on short notice.

While the present invention has been particularly shown and described with reference to one preferred embodiment thereof, it will be understood by those skilled in the art that various alterations in form and detail may be made therein without departing from the spirit and scope of the present invention.

What is claimed is:

1. A portable electronic display device comprising:

(a) an electronic display surface including at least one display panel that displays a graphical and/or textual message;

(b) memory that stores a plurality of the messages;

(c) one or more switches on the device that allow user selection of one of the messages; and (d) a controller that disables the one or more switches if none of the switches are selected after a predetermined period of time after power is turned on to the display device, thereby preventing a user from subsequently changing the message via the one or more switches.

2. The device according to claim 1 wherein the controller re-enables the one or more switches upon detection of disconnection and reconnection of power to the display device.

3. A portable electronic display device comprising:

(a) an electronic display surface including at least one display panel that displays a graphical and/or textual message;

(b) memory that stores a plurality of the messages;

(c) one or more switches on the device that allow user selection of one of the messages; and (d) a controller that disables the one or more switches if none of the switches are selected after a predetermined period of time subsequent to the last switch selection occurrence, thereby preventing a user from subsequently changing the message via the one or more switches.

4. The device according to claim 3 wherein the controller re-enables the one or more switches upon detection of disconnection and reconnection of power to the display device.

* * * * *